US012516504B2

(12) United States Patent
Kawamoto et al.

(10) Patent No.: US 12,516,504 B2
(45) Date of Patent: Jan. 6, 2026

(54) CONSTRUCTION MACHINE

(71) Applicant: KOBELCO CONSTRUCTION MACHINERY CO., LTD., Hiroshima (JP)

(72) Inventors: Masahiro Kawamoto, Hiroshima (JP); Masashi Kamada, Hiroshima (JP); Kazushige Koiwai, Hiroshima (JP); Natsuki Yumoto, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 441 days.

(21) Appl. No.: 18/252,262

(22) PCT Filed: Oct. 26, 2021

(86) PCT No.: PCT/JP2021/039412
§ 371 (c)(1),
(2) Date: May 9, 2023

(87) PCT Pub. No.: WO2022/102391
PCT Pub. Date: May 19, 2022

(65) Prior Publication Data

US 2024/0011248 A1 Jan. 11, 2024

(30) Foreign Application Priority Data

Nov. 16, 2020 (JP) ..... 2020-190091

(51) Int. Cl.
*E02F 9/22* (2006.01)
*E02F 9/12* (2006.01)

(52) U.S. Cl.
CPC ..... *E02F 9/2296* (2013.01); *E02F 9/123* (2013.01); *E02F 9/2292* (2013.01)

(58) Field of Classification Search
CPC ..... E02F 9/2296; E02F 9/123; E02F 9/2292; F15B 21/082; F15B 21/087
See application file for complete search history.

(56) References Cited

U.S. PATENT DOCUMENTS 5,214,916 A * 6/1993 Lukich ..... E02F 9/2292 60/431
9,394,670 B2 * 7/2016 Hijikata ..... F15B 21/14
(Continued)

FOREIGN PATENT DOCUMENTS

JP 5-263442 A 10/1993
JP 2015-197185 A 11/2015
(Continued)

OTHER PUBLICATIONS

International Search Report Issued Dec. 28, 2021, in PCT/JP2021/039412, filed on Oct. 26, 2021, 2 pages.

*Primary Examiner* — Redhwan K Mawari
(74) *Attorney, Agent, or Firm* — Oblon, McClelland, Maier & Neustadt, L.L.P.

(57) ABSTRACT

A speed compensation part included in a construction machine executes a feedback control of regulating an opening degree of a second control valve to an opening degree obtained by subtracting a correction amount from a second target opening degree of the second control valve, when a combined manipulation is performed and a preset load determination condition is satisfied. The correction amount is calculated by the speed compensation part so as to be larger as a speed difference between a first target speed and a first actual speed becomes larger, the first target speed being a target speed of a first actuator and determined on the basis of a manipulation amount of a first instructive manipulation, the first actual speed being an actual speed of the first actuator.

9 Claims, 13 Drawing Sheets

(56) References Cited

U.S. PATENT DOCUMENTS

| | | | | |
|---|---|---|---|---|
| 10,030,361 | B2 * | 7/2018 | Hijikata | E02F 9/123 |
| 10,787,790 | B2 * | 9/2020 | Imura | E02F 9/22 |
| 11,060,261 | B2 * | 7/2021 | Ueda | B66C 23/86 |
| 2012/0151905 | A1 * | 6/2012 | Lenton | B60W 10/103 60/431 |
| 2012/0285159 | A1 * | 11/2012 | Sugano | B66D 1/44 60/470 |
| 2013/0137547 | A1 * | 5/2013 | Ho | B60W 10/026 477/181 |
| 2014/0105714 | A1 * | 4/2014 | Kim | E02F 9/2292 60/459 |
| 2014/0178167 | A1 * | 6/2014 | Goto | F15B 11/048 60/446 |
| 2014/0238010 | A1 * | 8/2014 | Joung | E02F 9/2282 60/428 |
| 2018/0058042 | A1 * | 3/2018 | Moriki | E02F 9/2235 |
| 2018/0238025 | A1 * | 8/2018 | Imura | E02F 9/268 |
| 2019/0292753 | A1 * | 9/2019 | Oka | E02F 9/2235 |
| 2019/0338494 | A1 * | 11/2019 | Moriki | E02F 9/2029 |
| 2023/0112211 | A1 * | 4/2023 | Horii | E02F 9/2296 414/680 |

FOREIGN PATENT DOCUMENTS

| | | | | |
|---|---|---|---|---|
| JP | WO2014061741 | A1 * | 9/2016 | F15B 13/02 |
| JP | 2017-180712 | A | 10/2017 | |
| JP | 2019-27261 | A | 2/2019 | |

* cited by examiner

CONSTRUCTION MACHINE

TECHNICAL FIELD

The present disclosure relates to a construction machine, such as a hydraulic excavator.

BACKGROUND ART

A construction machine, such as a hydraulic excavator, generally includes: a lower travelling body; an upper slewing body slewably mounted on the lower travelling body; a working device including a boom attached to the upper slewing body; a slewing motor being a hydraulic motor for slewing the upper slewing body; a boom cylinder being a hydraulic cylinder for driving the boom; a first hydraulic pump that discharges hydraulic fluid to be supplied to the slewing motor; a second hydraulic pump that discharges hydraulic fluid to be supplied to the boom cylinder; a slewing control valve located between the first hydraulic pump and the slewing motor; and a boom control valve located between the second hydraulic pump and the boom cylinder. The hydraulic fluid discharged from the first hydraulic pump is supplied to other actuator (e.g., the boom cylinder) in addition to the slewing motor in many cases. In this case, the construction machine further includes a joining valve. The joining valve is located between the first hydraulic pump and the boom cylinder, and opens and closes to permit a part of the hydraulic fluid discharged from the first hydraulic pump to join the hydraulic fluid discharged from the second hydraulic pump so as to be supplied to the boom cylinder. The joining valve is required to appropriately distribute the hydraulic fluid to the slewing motor and the boom cylinder to keep a balance between a slewing operation of the upper slewing body and a rising and lowering operation of the boom in the above-described construction machine.

Patent Literature 1 discloses a slewing-type hydraulic working machine including a joining valve, i.e., two-speed boom control valve in Patent Literature 1, like the one described above. In the slewing-type hydraulic working machine, when a first instructive manipulation is given to a slewing lever and a boom raising instructive manipulation is given to a boom raising lever, that is, when a combined manipulation is performed, a controller executes a control of flow rate distribution of hydraulic fluid discharged from a hydraulic pump to a slewing motor and a boom cylinder. Specifically, in a high likelihood of demand for acceleration of slewing, the controller operates to ensure a slewing torque necessary for the acceleration by regulating an actuator flow rate at a large restriction degree to keep a high working pressure of the slewing motor.

The slewing-type hydraulic working machine disclosed in Patent Literature 1 can increase an actual speed of the slewing motor (a rotational speed of the slewing motor) by controlling the flow rate distribution of the hydraulic fluid to ensure the slewing torque necessary for the acceleration of the slewing in the above-described manner in the high likelihood of the demand for the acceleration in performance of the combined manipulation, but the machine is not intended for consideration of accurate regulation of the actual speed of the slewing motor to a target speed.

The aforementioned drawbacks can be seen not only in the combination of the slewing motor and the boom cylinder, but also in a combination of two hydraulic actuators in which at least one of the slewing motor and the boom cylinder is replaced with another actuator.

CITATION LIST

Patent Literature

Patent Literature 1: Japanese Unexamined Patent Publication No. 2019-27261

SUMMARY OF INVENTION

This disclosure has an object of providing a construction machine which enables accurate regulation of an actual speed of a first actuator to a target speed even when a load of the first actuator is larger than a load of a second actuator in performance of a combined manipulation.

Provided is a construction machine including: a first pump being a variable displacement hydraulic pump for discharging hydraulic fluid; a second pump being a variable displacement hydraulic pump for discharging hydraulic fluid; a first actuator that receives a supply of the hydraulic fluid discharged from the first pump to come into operation; a second actuator that receives a supply of the hydraulic fluid discharged from the second pump to come into operation; a first control valve that is located between the first pump and the first actuator, and opens and closes to change a flow rate of the hydraulic fluid to be supplied from the first pump to the first actuator; a second control valve that is located between the first pump and the second actuator, and opens and closes to change a flow rate of the hydraulic fluid to be supplied from the first pump to the second actuator; a third control valve that is located between the second pump and the second actuator, and opens and closes to change a flow rate of the hydraulic fluid to be supplied from the second pump to the second actuator; a first manipulation device that receives a first instructive manipulation for instructing an operation of the first actuator; a second manipulation device that receives a second instructive manipulation for instructing an operation of the second actuator; a pump control part that regulates a discharge rate of the first pump and a discharge rate of the second pump so that the hydraulic fluid is discharged at a total target flow rate from at least one of the first pump and the second pump, the total target flow rate being a sum of a first target flow rate which is a target flow rate of the hydraulic fluid to the first actuator and determined on the basis of a manipulation amount of the first instructive manipulation and a second target flow rate which is a target flow rate of the hydraulic fluid to the second actuator and determined on the basis of a manipulation amount of the second instructive manipulation; a valve control part that regulates an opening degree of the first control valve to a first target opening degree determined on the basis of the first target flow rate, regulates an opening degree of the second control vale to a second target opening degree determined on the basis of a second control valve target flow rate which is a target flow rate of the hydraulic fluid to the second actuator via the second control valve and a part of the second target flow rate, and regulates an opening degree of the third control valve to a third target opening degree determined on the basis of a third control valve target flow rate which is a target flow rate of the hydraulic fluid to the second actuator via the third control valve and a part of the second target flow rate; a condition determination part that determines whether a preset load determination condition is satisfied, the load determination condition being a condition to determine that a first load being a load of the first actuator is larger than a second load being a load of the second actuator; and a speed compensation part that executes a feedback control of regulating the opening degree of the second control valve to an opening degree obtained by subtracting a correction amount from the second target opening degree, when a combined manipulation of giving the first instructive manipulation to the first manipulation device and giving the second instructive manipulation to the second manipulation device is performed and the condition determination part determines that the load determination condition is satisfied, the correction amount being calculated by the speed compensation part so as to be larger as a speed difference between a first target speed and a first actual speed becomes larger, the first target speed being a target speed of the first actuator and determined on the basis of the manipulation amount of the first instructive manipulation, the first actual speed being an actual speed of the first actuator.

DESCRIPTION OF EMBODIMENTS

Figure 1:
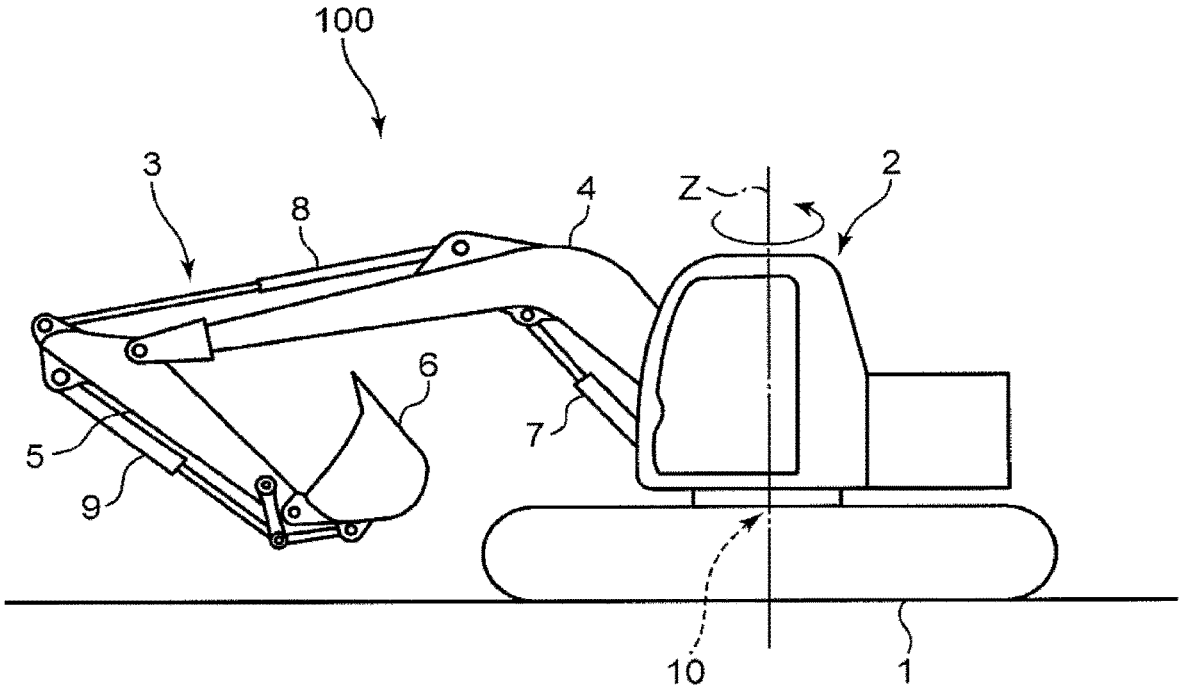
FIG. 1 is a side view of a construction machine according to embodiments of the present disclosure.

Preferable embodiments of the present disclosure will be described with reference to the accompanying drawings. FIG. 1 is a side view of a hydraulic excavator which is an example of a construction machine 100 according to the embodiments of the present disclosure.

The construction machine 100 includes a lower travelling body 1 travelable on a ground, an upper slewing body 2 mounted on the lower travelling body 1 slewably about an axis Z extending in an up-down direction, a working device 3 mounted on the upper slewing body 2, and a plurality of hydraulic actuators. The upper slewing body 2 has a front portion on which a cab serving as an operating compartment is provided and the working device 3 is mounted in a front-rear direction. The upper slewing body has a rear portion on which an engine room is provided and a counterweight is mounted. The working device 3 includes a boom 4, an arm 5, and a bucket 6. The hydraulic actuators include a boom cylinder 7, an arm cylinder 8, a bucket cylinder 9, and a slewing motor 10.

The boom 4 is tiltably supported by the front portion of the upper slewing body 2. The boom 4 has a proximal end attached to the upper slewing body 2 rotatably about a horizontal axis to the upper slewing body 2 in the up-down direction, and a distal end opposite to the proximal end. The arm 5 has a proximal end connected to the distal end of the boom 4 rotatably about a horizontal axis, and a distal end opposite to the proximal end. The bucket 6 has a proximal end connected to the distal end of the arm 5 rotatably about a horizontal axis.

The boom 4 performs a boom rising operation of rotating about the proximal end thereof in a rising direction, and performs a boom lowering operation of rotating about the proximal end in a lowering direction. The rising direction indicates a direction in which the distal end of the boom 4 moves away from the ground, and the lowering direction indicates a direction in which the distal end of the boom 4 moves closer to the ground. The arm 5 performs an arm pushing operation of rotating frontward about the proximal end thereof, and an arm pulling operation of rotating rearward about the proximal end thereof. The bucket 6 performs a bucket pushing operation of rotating about the proximal end thereof, and a bucket pulling operation of rotating about the proximal end thereof.

The boom cylinder 7 has one end connected to the upper slewing body 2 and another end connected to the boom 4. The boom cylinder 7 extends to allow the boom 4 to perform the boom rising operation that the boom 4 rotates in the rising direction, and the boom cylinder 7 contracts to allow the boom 4 to perform the lowering operation that the boom 4 rotates in the lowering direction.

The arm cylinder 8 has one end connected to the boom 4 and another end connected to the arm 5. The arm cylinder 8 extends to allow the arm 5 to perform the arm pulling operation, and the arm cylinder 8 contracts to allow the arm 5 to perform the arm pushing operation.

The bucket cylinder 9 has one end connected to the arm 5 and another end connected to the bucket 6. The bucket cylinder 9 extends to allow the bucket 6 to perform the bucket pulling operation, and the bucket cylinder 9 contracts to allow the bucket 6 to perform the bucket pushing operation.

First Embodiment

Figure 2:
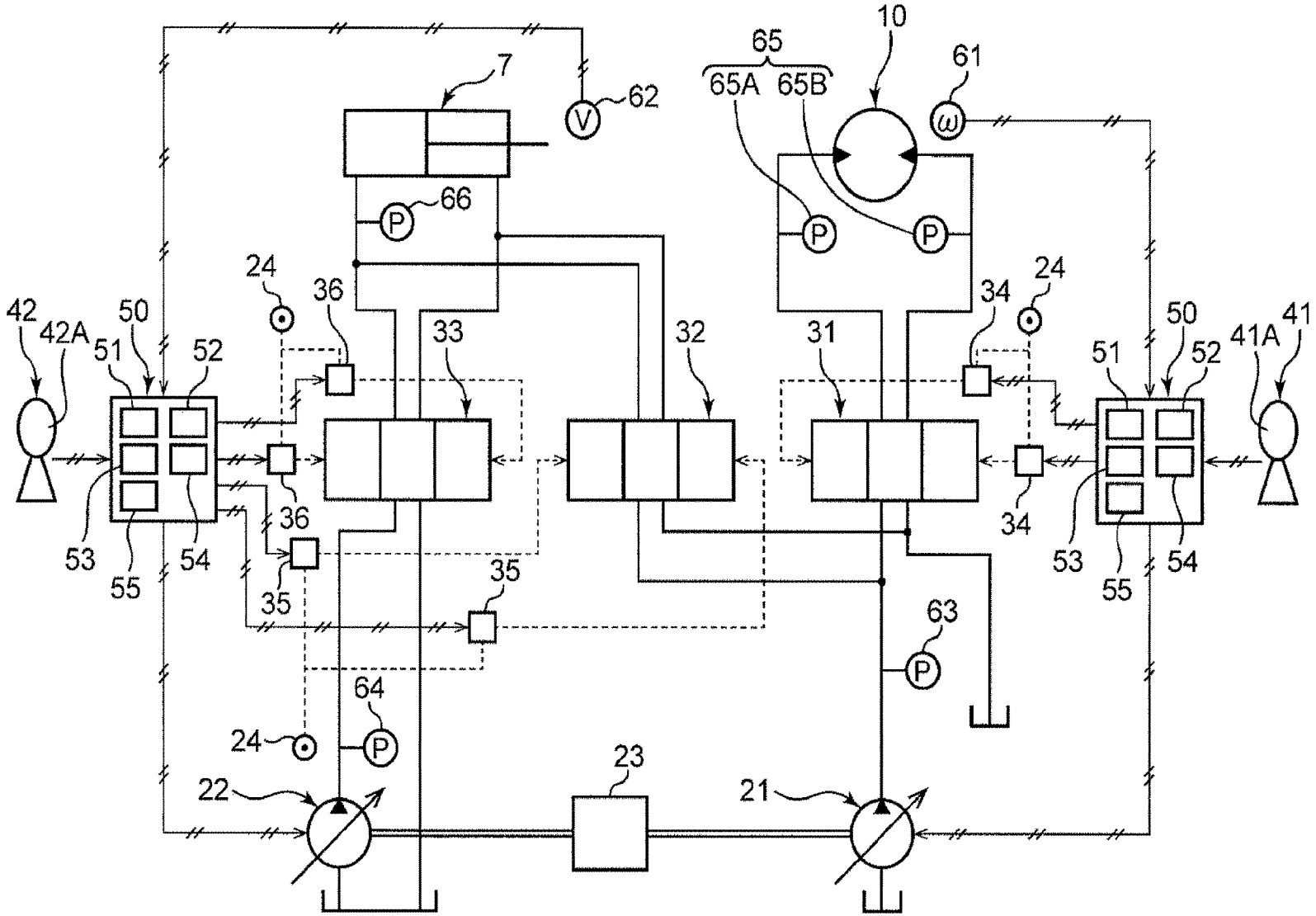
FIG. 2 is a diagram showing a hydraulic circuit of the construction machine according to a first embodiment.

FIG. 2 is a diagram showing a hydraulic circuit of the construction machine 100 according to a first embodiment. As shown in FIG. 2, the construction machine 100 includes a first pump 21, a second pump 22, an engine 23, a plurality of control valves, a plurality of manipulation devices, a plurality of solenoid proportional pressure reducing valves, a pilot hydraulic pressure source 24, a plurality of detectors, a tank, and a controller 50. The hydraulic circuit shown in FIG. 2 illustrates only constituent elements related to the boom cylinder 7 and the slewing motor 10, and omits illustration of other constituent elements.

Each of the first pump 21 and the second pump 22 is a variable displacement hydraulic pump, and is connected to an output shaft of the engine 23. The first pump 21 and the second pump 22 are driven by the engine 23 for discharging hydraulic fluid in the tank. Each of the first pump 21 and the second pump 22 has a regulator, and is configured to change a discharge rate of the hydraulic fluid by changing a tilt angle and changing a motor capacity in response to a discharge rate instruction input to the regulator from the controller 50.

The slewing motor 10 is a hydraulic motor that receives a supply of the hydraulic fluid discharged from the first pump 21 to come into operation for slewing the upper slewing body 2. The slewing motor 10 has an unillustrated output shaft which rotates by a supply of the hydraulic fluid, and the output shaft is connected to the upper slewing body 2 to slew the upper slewing body 2 in left and right directions. Specifically, the slewing motor 10 has a pair of ports for receiving a supply of the hydraulic fluid to one of the ports so that the output shaft rotates in a direction corresponding to the one of the ports, and discharging the hydraulic fluid from the other of the ports. The slewing motor 10 serves as an example of the first actuator.

The boom cylinder 7 extends or contracts owing to the supply of at least one of the hydraulic fluid discharged from the first pump 21 and the hydraulic fluid discharged from the second pump 22 to thereby rotate the boom 4 in the rising direction or the lowering direction. The boom cylinder 7 serves as an example of the second actuator.

The control valves include a first control valve 31, a second control valve 32, a third control valve 33.

The first control valve 31 is located between the first pump 21 and the slewing motor 10, and opens and closes to change a direction and a flow rate of the hydraulic fluid to be supplied from the first pump 21 to the slewing motor 10. The first control valve 31 is a three-position direction selector valve having a pair of pilot ports, and has a flow rate regulating function of changing the flow rate of the hydraulic fluid by regulating an opening degree (an opening amount) of the first control valve 31 in accordance with a displacement amount of a spool included in the valve or a position of the spool.

The second control valve 32 is located between the first pump 21 and the boom cylinder 7, and opens and closes to change a direction and a flow rate of the hydraulic fluid to be supplied from the first pump 21 to the boom cylinder 7. The second control valve 32 is a three-position direction selector valve having a pair of pilot ports, and has a flow rate regulating function of changing the flow rate of the hydraulic fluid by regulating an opening degree (an opening amount) of the second control valve 32 in accordance with a displacement amount of a spool included in the valve or a position of the spool.

The third control valve 33 is located between the second pump 22 and the boom cylinder 7, and opens and closes to change a direction and a flow rate of the hydraulic fluid to be supplied from the second pump 22 to the boom cylinder 7. The third control valve 33 is a three-position direction selector valve having a pair of pilot ports, and has a flow rate regulating function of changing the flow rate of the hydraulic fluid by regulating an opening degree (an opening amount) of the third control valve 33 in accordance with a displacement amount of a spool included in the valve or a position of the spool.

The manipulation devices include a first manipulation device 41 and a second manipulation device 42.

The first manipulation device 41 has a first manipulation lever 41A that receives a first instructive manipulation for instructing an operation of the slewing motor 10. The first manipulation device 41 is an electric lever device that outputs, in response to the first instructive manipulation, a first instruction signal which is an electric signal corresponding to the first instructive manipulation. The first instruction signal output from the first manipulation device is input to the controller 50.

The second manipulation device 42 has a second manipulation lever 42A that receives a second instructive manipulation for instructing an operation of the boom cylinder 7. The second manipulation device 42 is an electric lever device that outputs, in response to the second instructive manipulation, a second instruction signal which is an electric signal corresponding to the second instructive manipulation. The second instruction signal output from the second manipulation device 42 is input to the controller 50.

The solenoid proportional pressure reducing valves include a pair of solenoid proportional pressure reducing valves 34, 34, a pair of solenoid proportional pressure reducing valves 35, 35, and a pair of solenoid proportional pressure reducing valves 36, 36.

The pair of solenoid proportional pressure reducing valves 34, 34 is provided on a pair of pilot lines connecting the pilot hydraulic pressure source 24 and the pair of pilot ports of the first control valve 31 to each other. The pair of solenoid proportional pressure reducing valves 35, 35 is provided on a pair of pilot lines connecting the pilot hydraulic pressure source 24 and the pair of pilot ports of the second control valve 32 to each other. The pair of solenoid proportional pressure reducing valves 36, 36 is provided on a pair of pilot lines connecting the pilot hydraulic pressure source 24 and the pair of pilot ports of the third control valve 33 to each other.

The controller 50 receives an input of the first instruction signal, and causes one solenoid proportional pressure reducing valve 34 to open and close so that a pilot pressure corresponding to the first instruction signal is input to one pilot port of the first control valve 31. The one solenoid proportional pressure reducing valve 34 is one of the two solenoid proportional pressure reducing valves 34, 34 and corresponds to a direction of the first instructive manipulation. The one pilot port is one of the two pilot ports and corresponds to the direction of the first instructive manipulation.

The controller 50 receives an input of the second instruction signal, and causes one solenoid proportional pressure reducing valve 35 to open and close so that a pilot pressure corresponding to the second instruction signal is input to one pilot port of the second control valve 32. The one solenoid proportional pressure reducing valve 35 is one of the two solenoid proportional pressure reducing valves 35, 35 and corresponds to a direction of the second instructive manipulation. The one pilot port is one of the two pilot ports and corresponds to the direction of the second instructive manipulation.

The controller 50 receives an input of the second instruction signal, and causes one solenoid proportional pressure reducing valve 36, 36 to open and close so that a pilot pressure corresponding to the second instruction signal is input to one pilot port of the third control valve 33. The one solenoid proportional pressure reducing valve 36 is one of the two solenoid proportional pressure reducing valves 36, 36 and corresponds to the direction of the second instructive manipulation. The one pilot port is one of the two pilot ports and corresponds to the direction of the second instructive manipulation.

The first control valve 31, the second control valve 32, and the third control valve 33 have their respective spools. Each spool is at a neutral position when neither of the pilot ports receives a supply of a pilot pressure. The first control valve 31 bearing the spool thereof at the neutral position suspends a rotation of the slewing motor 10 by blocking the supply of the hydraulic fluid from the first pump 21 to the slewing motor 10. The second control valve 32 bearing the spool thereof at the neutral position blocks the supply of the hydraulic fluid from the first pump 21 to the boom cylinder 7, and the third control valve 33 bearing the spool thereof at the neutral position blocks the supply of the hydraulic fluid from the second pump 22 to the boom cylinder 7. When the spool of the second control valve 32 is at the neutral position and the spool of the third control valve 33 is at the neutral position, the boom cylinder 7 receives no supply of the hydraulic fluid from both the first pump 21 and the second pump 22. Accordingly, the boom cylinder 7 is suspended.

A supply of a pilot pressure to one pilot port in the pair of pilot ports of the first control valve 31 causes the spool to shift from the neutral position in a direction corresponding to the one pilot port by a displacement amount corresponding to the pilot pressure. In this manner, the first control valve 31 has an opening degree (an opening amount) regulated to correspond to the displacement amount, and permits a supply of the hydraulic fluid from the first pump 21 to one port of the slewing motor 10 at a flow rate corresponding to the displacement amount and permits return of the hydraulic fluid from the other port to the tank.

A supply of a pilot pressure to one pilot port in the pair of pilot ports of the second control valve 32 causes the spool to shift from the neutral position in a direction corresponding to the one pilot port by a displacement amount corresponding to the pilot pressure. In this manner, the second control valve 32 has an opening degree (an opening amount) regulated to correspond to the displacement amount, and permits a supply of the hydraulic fluid from the first pump 21 to one of a head chamber and a rod chamber of the boom cylinder 7 at a flow rate corresponding to the displacement amount and permits return of the hydraulic fluid from the other of the head chamber and the rod chamber to the tank.

A supply of a pilot pressure to one pilot port in the pair of pilot ports of the third control valve 33 causes the spool to shift from the neutral position in a direction corresponding to the one pilot port by a displacement amount corresponding to the pilot pressure. In this manner, the third control valve 33 has an opening degree (an opening amount) regulated to correspond to the displacement amount, and permits a supply of the hydraulic fluid from the second pump 22 to one of the head chamber and the rod chamber of the boom cylinder 7 at a flow rate corresponding to the displacement amount and permits return of the hydraulic fluid from the other of the head chamber and the rod chamber to the tank.

The detectors include a first speed detector 61, a second speed detector 62, a first discharge pressure detector 63, and a second discharge pressure detector 64. The first speed detector 61 is a sensor that detects a rotational speed of the slewing motor 10. The sensor may adopt, for example, a rotary encoder, a resolver, or other sensor. The second speed detector 62 is a sensor that detects an extension and contraction speed of the boom cylinder 7. The first discharge pressure detector 63 is a pressure sensor that detects a first discharge pressure being a discharge pressure of the hydraulic fluid from the first pump 21. The second discharge pressure detector 64 is a pressure sensor that detects a second discharge pressure being a discharge pressure of the hydraulic fluid from the second pump 22. The first speed detector 61 serves as an example of the first detector.

The controller 50 is composed of a computer including, for example, a CPU, a memory, and other elements, and includes a valve control part 51, a pump control part 52, a condition determination part 53, a speed compensation part 54, and an output determination part 55. FIG. 2 shows two blocks each denoting the controller 50 as a matter of convenience, but the two blocks constitute a single controller 50 in reality.

The pump control part 52 regulates a discharge rate of the first pump 21 and a discharge rate of the second pump 22 so that the hydraulic fluid is discharged at a total target flow rate from at least one of the first pump 21 and the second pump 22, the total target flow rate being a sum of a first target flow rate which is a target flow rate of the hydraulic fluid to the slewing motor 10 and determined on the basis of a manipulation amount of the first instructive manipulation and a second target flow rate which is a target flow rate of the hydraulic fluid to the boom cylinder 7 and determined on the basis of a manipulation amount of the second instructive manipulation.

The controller 50 stores, in advance, a map for allowing the pump control part 52 to regulate the discharge rate of the first pump 21 and the discharge rate of the second pump 22.

Figure 10:
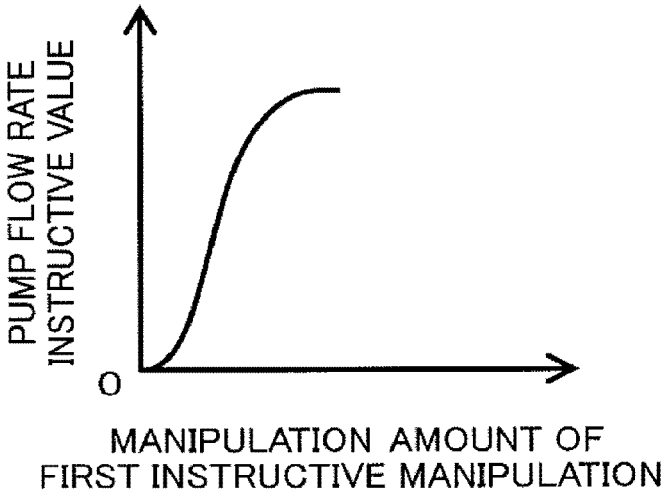
FIG. 10 is an example of a map showing a relation between a manipulation amount of a first instructive manipulation and a pump flow rate instructive value.

For instance, the pump control part 52 obtains a pump flow rate instructive value (a first instructive value) corresponding to a manipulation amount of the first instructive manipulation from a map showing a relation between a manipulation amount of the first instructive manipulation given to the first manipulation device 41 and a pump flow rate instructive value as illustrated in FIG. 10, and outputs the obtained first instructive value. Similarly, for instance, the pump control part 52 obtains a pump flow rate instructive value (a second instructive value) corresponding to a manipulation amount of the second instructive manipulation from a map showing a relation between a manipulation amount of the second instructive manipulation given to the second manipulation device 42 and a pump flow rate instructive value as illustrated in FIG. 11, and outputs the obtained second instructive value.

Figure 11:
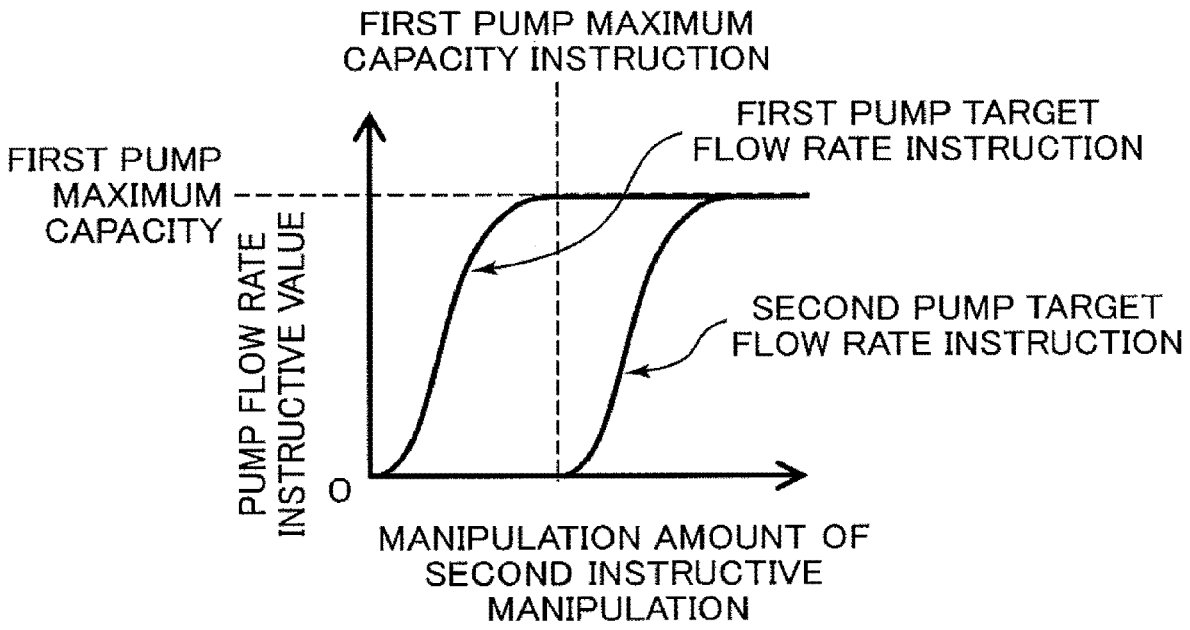
FIG. 11 is an example of a map showing a relation between a manipulation amount of a second instructive manipulation and a pump flow rate instructive value.

The map illustrated in FIG. 11 represents an aspect where only the first pump 21 of the first pump 21 and the second pump 22 is used until a capacity of the first pump 21 reaches a maximum capacity, and then the second pump 22 is started to be used after the capacity of the first pump 21 reaches the maximum capacity. In this aspect, the capacity of the first pump 21 is regulated to a sum of a capacity corresponding to the first instructive value and a capacity corresponding to the second instructive value until the capacity of the first pump 21 reaches the maximum capacity. Accordingly, the first pump 21 discharges the hydraulic fluid at a rate of the sum of the first target flow rate and the second target flow rate. After the capacity of the first pump 21 reaches the maximum capacity, the capacity of the first pump 21 is regulated to the maximum capacity, and a capacity of the second pump 22 is regulated to a capacity corresponding to the second instructive value which is an instructive value corresponding to a manipulation amount of the second instructive manipulation in the map illustrated in FIG. 11. Consequently, the first pump 21 discharges the hydraulic fluid at a discharge rate corresponding to the maximum capacity, and the second pump 22 discharges the hydraulic fluid at a discharge rate responsive to a second instruction. The discharge rate responsive to the second instruction for the discharge from the second pump 22 is obtained by subtracting a discharge rate corresponding to the maximum capacity of the first pump 21 from the total target flow rate being the sum of the first target flow rate and the second target flow rate.

However, the map showing the relation between the manipulation amount of the second instructive manipulation and the pump flow rate instructive value is not limited to the aspect represented in FIG. 11. The map showing the relation between the manipulation amount of the second instructive value and the pump flow rate instructive value may represent another aspect where, for example, the first pump 21 and the second pump 22 are started to be used at the same time. Alternatively, the map showing the relation between the manipulation amount of the second instructive manipulation and the pump flow rate instructive value may represent further another aspect where, for example, only the second pump 22 of the first pump 21 and the second pump 22 is used for the second target flow rate until the capacity of the second pump 22 reaches a maximum capacity, and then the first pump 21 is also used for the second target flow rate after the capacity of the second pump 22 reaches the maximum capacity. In the latter case, the first pump 21 is additionally used in a situation where the first instructive manipulation is given to the first manipulation device 41 even before the capacity of the second pump 22 reaches the maximum capacity.

The valve control part 51 regulates the opening degree of the first control valve 31 to a first target opening degree being a target opening degree of the first control valve 31, regulates the opening degree of the second control valve 32 to a second target opening degree being a target opening degree of the second control valve 32, and regulates the opening degree of the third control valve 33 to a third target opening degree being a target opening degree of the third control valve 33.

The first target opening degree is a target opening degree of the first control valve 31 determined on the basis of the first target flow rate. The second target opening degree is an opening degree determined on the basis of a second control valve target flow rate which is a target flow rate of the hydraulic fluid to the boom cylinder 7 via the second control valve 32, the second control valve target flow rate being a part of the second target flow rate. The third target opening degree is an opening degree determined on the basis of a third control valve target flow rate which is a target flow rate of the hydraulic fluid to the boom cylinder 7 via the third control valve 33, the third control valve target flow rate being a part of the second target flow rate.

The controller 50 stores, in advance, a map for allowing the valve control part 51 to regulate the opening degree of the first control valve 31, the opening degree of the second control valve 32, and the opening degree of the third control valve 33.

Figure 12:
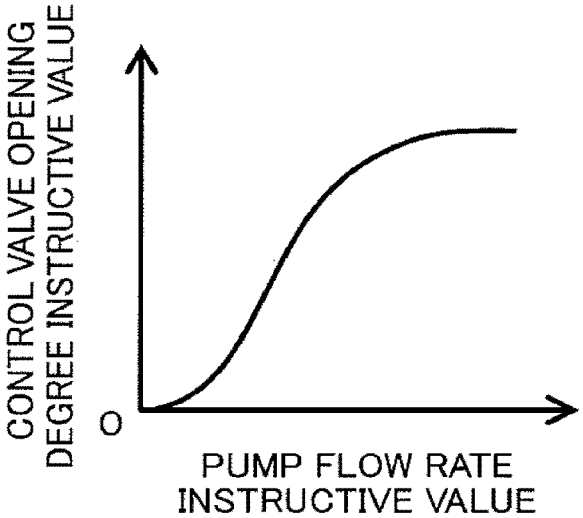
FIG. 12 is an example of a map showing a relation between the pump flow rate instructive value and a control valve opening degree instructive value.

For instance, the valve control part 51 obtains a control valve opening instructive value corresponding to a pump flow rate instructive value from a map showing a relation between the pump flow rate instructive value and the control valve opening instructive value (control valve opening degree instructive value) as shown in FIG. 12, and outputs the obtained control valve opening instructive value.

Specifically, the valve control part 51 obtains: a pump flow rate instructive value (a first instructive value) obtained from the map illustrated in FIG. 10, i.e., a pump flow rate instructive value corresponding to the manipulation amount of the first instructive manipulation; and an opening instructive value of the first control valve from the map illustrated in FIG. 12, and outputs the obtained opening instructive value. In response to an input of the opening instructive value to the solenoid proportional pressure reducing valve 34 corresponding to the direction of the first instructive manipulation in the pair of the solenoid proportional pressure reducing valves 34, 34, the solenoid proportional pressure reducing valve 34 opens and closes to input a pilot pressure responsive to the opening instructive value to the corresponding pilot port of the first control valve 31. In this manner, the first control valve 31 is regulated to the first target opening degree determined on the first target flow rate.

After the capacity of the first pump 21 reaches the maximum capacity, the valve control part 51 obtains: a pump flow rate instructive value (a second instructive value) obtained from the map illustrated in FIG. 11, i.e., a pump flow rate instructive value corresponding to the manipulation amount of the second instructive manipulation; and an opening instructive value of the second control valve from a map (not shown) which is similar to the map illustrated in FIG. 12 and set for the second control valve 32, and outputs the opening instructive value. In response to an input of the opening instructive value to the solenoid proportional pressure reducing valve 35 corresponding to the direction of the second instructive manipulation in the pair of the solenoid proportional pressure reducing valves 35, 35, the solenoid proportional pressure reducing valve 35 opens and closes to input a pilot pressure responsive to the opening instructive value to the corresponding pilot port of the second control valve 32. In this manner, the second control valve 32 is regulated to the second opening degree determined on the basis of the second control valve target flow rate which is the target flow rate of the hydraulic fluid to the boom cylinder 7 via the second control valve 32, the second control valve target flow rate being a part of the second target flow rate.

The valve control part 51 obtains: a pump flow rate instructive value (a second instructive value) obtained from the map illustrated in FIG. 11, i.e., a pump flow rate instructive value corresponding to the manipulation amount of the second instructive manipulation; and an opening instructive value of the third control valve from a map which is similar to the map illustrated in FIG. 12 and set for the third control valve 33, and outputs the opening instructive value. In response to an input of the opening instructive value to the solenoid proportional pressure reducing valve 36 corresponding to the direction of the second instructive manipulation in the pair of the solenoid proportional pressure reducing valves 36, 36, the solenoid proportional pressure reducing valve 36 opens and closes to input a pilot pressure responsive to the opening instructive value to the corresponding pilot port of the third control valve 33. In this manner, the third control valve 33 is regulated to the third target opening degree determined on the basis of the third control valve target flow rate which is the target flow rate of the hydraulic fluid to the boom cylinder 7 via the third control valve 33, the third control valve target flow rate being a part of the second target flow rate.

The condition determination part 53 determines whether a load determination condition which is preset is satisfied. The load determination condition is a condition to determine that a first load being a load of the first actuator is larger than a second load being a load of the second actuator. In the first embodiment, the load determination condition includes a condition that the rotational speed of the slewing motor 10 detected by the first speed detector 61 is lower than a target rotational speed of the slewing motor 10. The condition determination part 53 determines that the load determination condition is satisfied when the rotational speed is lower than the target rotational speed.

The speed compensation part 54 executes a speed compensation control, when a combined manipulation of giving the first instructive manipulation to the first manipulation device 41 and giving the second instructive manipulation to the second manipulation device 42 is performed and the condition determination part 53 determines that the load determination condition is satisfied.

The speed compensation control includes a feedback control (a second control valve feedback control) of regulating the opening degree of the second control valve 32 to an opening degree obtained by subtracting a correction amount from the second target opening degree, the correction amount being calculated so as to be larger as a speed difference becomes larger, the speed difference being a difference between the target rotational speed of the slewing motor 10 determined on the basis of the manipulation amount of the first instructive manipulation and a rotational speed being an actual speed of the slewing motor 10.

In the second control valve feedback control, the speed compensation part 54 may actually calculate a speed difference between a first target speed and a first actual speed and calculate a correction amount so as to be larger as the calculated speed difference becomes larger, or the speed compensation part 54 may calculate a difference between the first target flow rate corresponding to the first target speed and a first actual flow rate corresponding to the first actual speed and calculate a correction amount so as to be larger as the calculated difference becomes larger.

The rotational speed of the slewing motor 10 serves as an example of the first actual speed, and the target rotational speed of the slewing motor 10 serves as an example of the first target speed.

Figure 13:
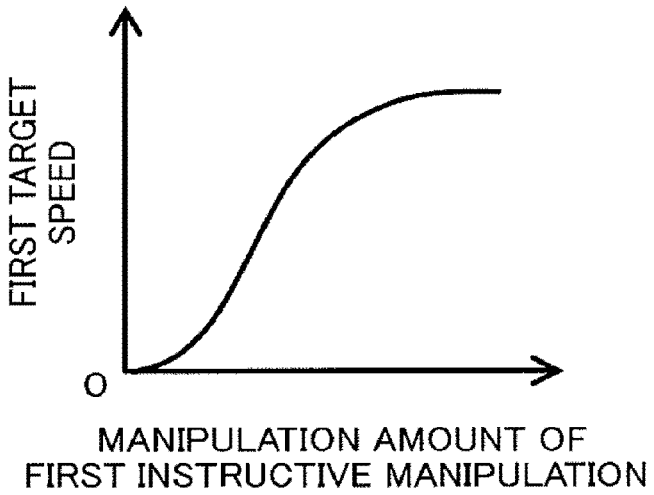
FIG. 13 is an example of a map showing a relation between the manipulation amount of the first instructive manipulation and a first target speed.

The first target speed is a target speed determined on the basis of the manipulation amount of the first instructive manipulation, and the second target speed is a target speed determined on the basis of the manipulation amount of the second instructive manipulation. The first target speed indicates a value highly correlated with the first target flow rate, and the second target speed indicates a value highly correlated with the second target flow rate. The controller 50 hence can calculate the first target speed from the first target flow rate by using a preset conversion formula, and can calculate the second target speed from the second target flow rate by using a preset conversion formula. Similarly, the controller 50 can calculate the first target flow rate from the first target speed by using a preset conversion formula, and calculate the second target flow rate from the second target speed by using a preset conversion formula. Moreover, the controller 50 can calculate, for example, the first target speed on the basis of a map presetting the relation between the manipulation amount of the first instructive manipulation and the first target speed as illustrated in FIG. 13, and on the basis of the first instruction signal output from the first manipulation device 41 and input to the controller 50. Similarly, the controller 50 can calculate the second target speed on the basis of an unillustrated map presetting a relation between the manipulation amount of the second instructive manipulation and the second target speed, and on the basis of the second instruction signal output from the second manipulation device 42 and input to the controller 50.

In the embodiment, the speed compensation control further includes a first control valve feedback control, a third control valve feedback control, and a pump feedback control.

The first control feedback control is a feedback control of regulating the opening degree of the first control valve 31 to an opening degree obtained by adding a correction amount to the first target opening degree, the correction amount being calculated so as to be larger as a speed difference between the first target speed and the first actual speed becomes larger.

In the first control valve feedback control, the speed compensation part 54 may actually calculate a speed difference between the first target speed and the first actual speed and calculate a correction amount so as to be larger as the calculated speed difference becomes larger, or the speed compensation part 54 may calculate a difference between the first target flow rate corresponding to the first target speed and the first actual flow rate corresponding to the first actual speed and calculate a correction amount so as to be larger as the calculated difference becomes larger.

The third control valve feedback control is a feedback control of regulating the opening degree of the third control valve 33 to an opening degree obtained by adding a correction amount to the third target opening degree, the correction amount being calculated so as to be larger as a speed difference becomes larger, the speed difference being a difference between the second target speed which is the target speed of the boom cylinder 7 and determined on the basis of the manipulation amount of the second instructive manipulation and a second actual speed which is an actual speed of the boom cylinder 7.

In the third control valve feedback control, the speed compensation part 54 may actually calculate a speed difference between the second target speed and the second actual speed and calculate a correction amount so as to be larger as the calculated speed difference becomes larger, or the speed compensation part 54 may calculate a difference between the second target flow rate corresponding to the second target speed and a second actual flow rate corresponding to the second actual speed and calculate a correction amount so as to be larger as the calculated difference becomes larger.

The pump feedback control is a feedback control of regulating the discharge rate of at least one of the first pump 21 and the second pump 22 so that a total discharge rate being a sum of the discharge rate of the first pump 21 and the discharge rate of the second pump 22 increases by a correction amount, the correction amount being calculated so as to be larger as a flow rate difference between the calculated total target flow rate and a calculated total actual flow rate becomes larger, the total target flow rate being a sum of the first target flow rate and the second target flow rate, the total actual flow rate being a sum of the first actual flow rate which is an actual flow rate of the hydraulic fluid supplied to the slewing motor 10 and the second actual flow rate which is an actual flow rate of the hydraulic fluid supplied to the boom cylinder 7.

The speed compensation control includes: making the opening degree of the first control valve 31 larger than the first target opening degree; making the opening degree of the second control valve 32 smaller than the second target opening degree; making the opening degree of the third control valve 33 larger than the third target opening degree; and increasing at least one of the discharge rate of the first pump 21 and the discharge rate of the second pump 22. Making the opening degree of the second control valve 32 smaller than the second target opening degree may involve closing the second control valve 32.

The output determination part 55 determines a maximum output from the engine 23. Hereinafter, more details will be described. The controller 50 stores, in advance, a map showing characteristics of a rotational speed of the engine and an output from the engine, the map being determined from a specification of the engine. The output determination part 55 determines a maximum output from the engine 23 on the basis of the map and an engine rotational speed instruction output from the controller 50 to the engine 23.

Figure 3:
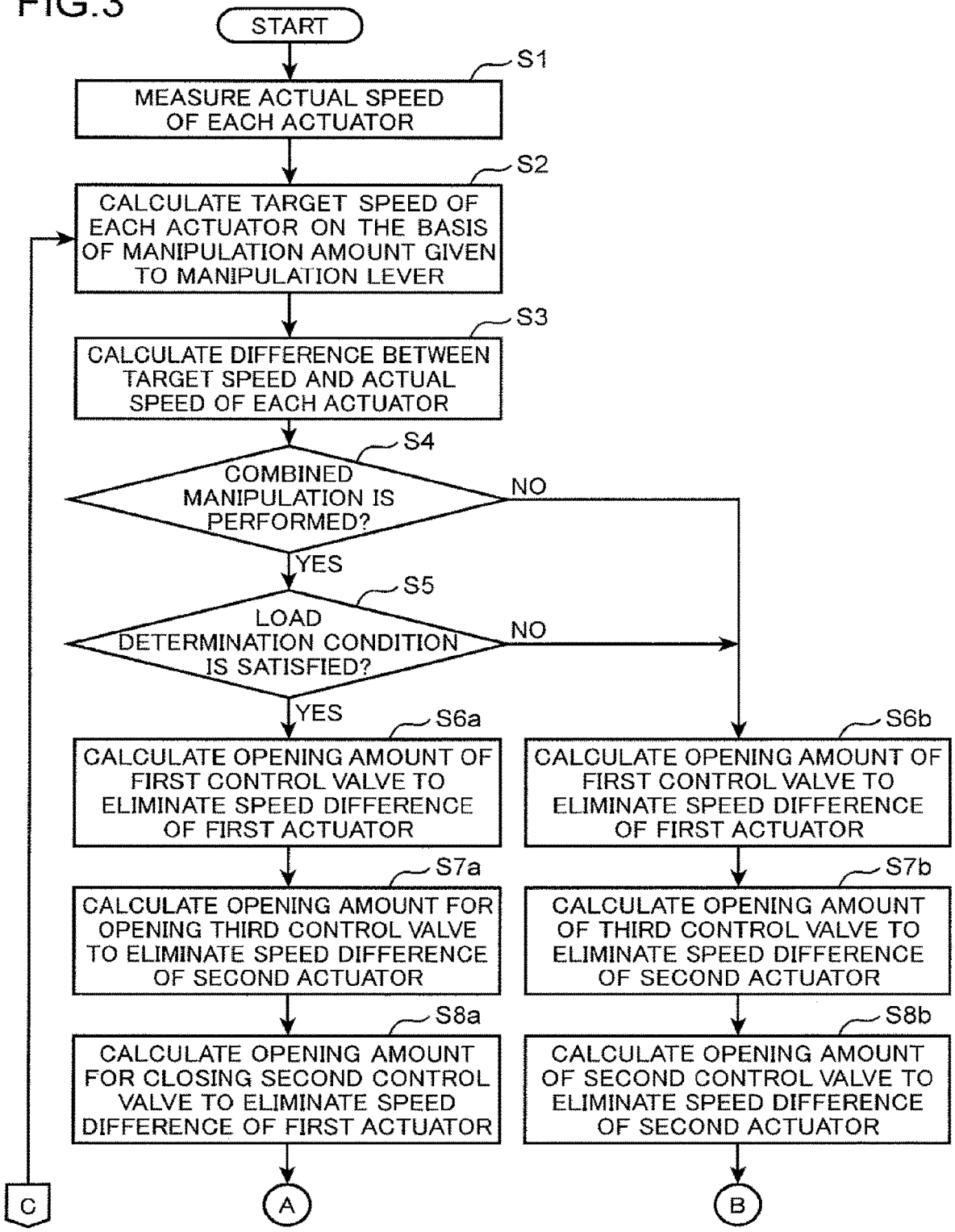
FIG. 3 is a flowchart showing a process executed by a controller included in the construction machine according to the first embodiment.
Figure 4:
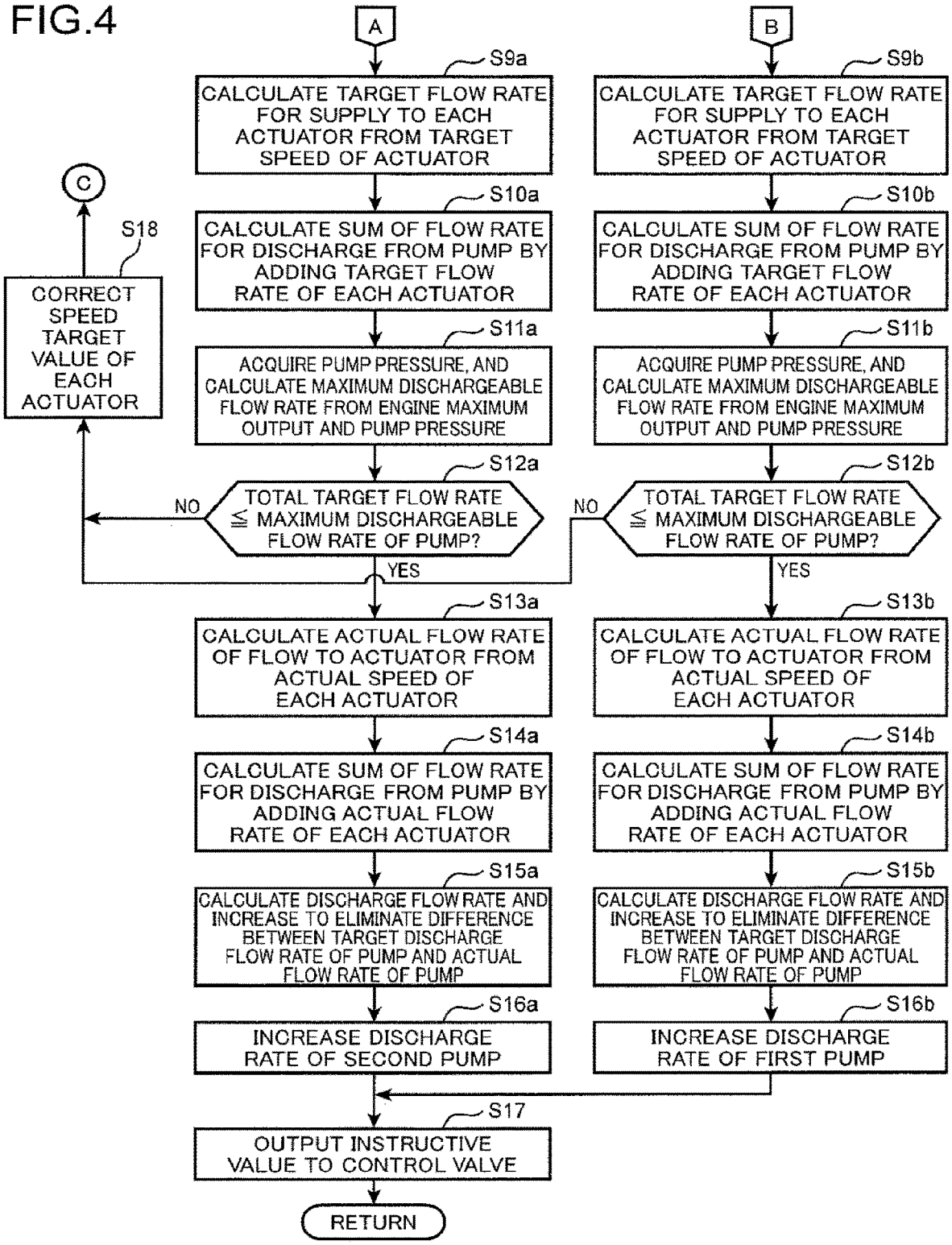
FIG. 4 is the flowchart showing the process executed by the controller of the construction machine according to the first embodiment.

FIG. 3 and FIG. 4 indicate a flowchart showing a control to be executed by the controller 50. Although FIG. 3 and FIG. 4 are of the two drawings in separation as a matter of convenience, the flowchart shown in FIG. 3 and FIG. 4 illustrates a series of control steps.

First, a signal corresponding to a detection value detected by each of the first speed detector 61, the second speed detector 62, the first discharge pressure detector 63, and the second discharge pressure detector 64 is input to the controller 50 (step S1).

Next, the controller 50 determines a first target speed on the basis of the map which is preset and a first instruction signal corresponding to a first instructive manipulation given to the first manipulation lever 41A of the first manipulation device 41. Similarly, the controller 50 determines a second target speed on the basis of the map which is preset and a second instruction signal corresponding to the second manipulation lever 42A of the second manipulation device 42 (step S2).

Subsequently, the speed compensation part 54 calculates a speed difference (the first target speed−the first actual speed) of the slewing motor 10 that is a difference between the first target speed and the first actual speed, and calculates a speed difference (the second target speed−the second actual speed) of the boom cylinder 7 that is a difference between the second target speed and the second actual speed (step S3).

Then, the speed compensation part 54 determines, on the basis of the first instruction signal and the second instruction signal, whether the combined manipulation is performed (step S4). When the combined manipulation is performed (YES in step S4), the condition determination part 53 determines whether a load determination condition is satisfied (step S5). In the first embodiment, the condition determination part 53 determines that the load determination condition is satisfied when the rotational speed (the first actual speed) is lower than the target rotational speed (the first target speed), that is, when the difference (the first target speed−the first actual speed) between the first actual speed and the first target speed indicates a positive value.

When the load determination condition is satisfied (YES in step S5), the controller 50 executes processing (a first speed compensation control) from steps S6*a* to S16*a*, S17, and S18. The first speed compensation control corresponds to the speed compensation control of the present disclosure. On the contrary, when the combined manipulation is not performed (NO in step S4) or the load determination condition is not satisfied (NO in step S5), the controller 50 executes processing (a second speed compensation control) from steps S6*b* to S16*b*, S17, and S18.

In the first speed compensation control from steps S6*a* to S16*a*, S17, and S18, the speed compensation part 54 executes a feedback control of regulating the opening degree of the first control valve 31 for allowing the speed difference of the slewing motor 10 to approach zero, executes a feedback control of regulating the opening degree of the second control valve 32 for allowing the speed difference of the slewing motor 10 to approach zero, and executes a feedback control of regulating the opening degree of the third control valve 33 for allowing the speed difference of the boom cylinder 7 to approach zero. More details will be described below.

The speed compensation part 54 calculates, by using the speed difference (the first target speed−the first actual speed) of the slewing motor 10 and Equation (1) described below for example, a correction value (a first correction value) of the opening degree (the opening amount) of the first control valve 31 for allowing the speed difference of the slewing motor 10 to approach zero (step S6*a*). The first correction value calculated in step S6*a* is a correction value for making the opening degree of the first control valve 31 larger than the first target opening degree. The speed compensation part 54 calculates a first opening instructive value obtained through correction of adding the first correction amount to the first target opening degree.

First correction value=proportional gain×speed difference+integral gain×integrated value of speed difference+derivative gain×differential value of speed difference (1)

The speed compensation part 54 calculates, by using the speed difference (the second target speed−the second actual speed) of the boom cylinder 7 and Equation (2) described below for example, a correction value (a third correction value) of the opening degree (the opening amount) of the third control valve 33 for allowing the speed difference of the boom cylinder 7 to approach zero (step S7*a*). The third correction value calculated in step S7*a* is a correction value for making the opening degree of the third control valve 33 larger than the third target opening degree. The speed compensation part 54 calculates a third opening instructive value obtained through correction of adding the third correction amount to the third target opening degree.

Third correction value=proportional gain×speed difference+integral gain×integrated value of speed difference+derivative gain×differential value of speed difference (2)

The speed compensation part 54 calculates, by using the speed difference (the first target speed−the first actual speed) of the slewing motor 10 and Equation (3) described below for example, a correction value (a second correction value) of the opening degree (the opening amount) of the second control valve 32 for allowing the speed difference of the slewing motor 10 to approach zero (step S8*a*). The second correction value calculated in step S8*a* is a correction value for making the opening degree of the second control valve 32 smaller than the second target opening degree. The speed compensation part 54 calculates a second opening instructive value obtained through correction of subtracting the second correction amount from the second target opening degree.

Second correction value=proportional gain×speed difference+integral gain×integrated value of speed difference+derivative gain×differential value of speed difference (3)

Subsequently, the speed compensation part 54 calculates, on the basis of the first target speed, a target flow rate (a first target flow rate) of the hydraulic fluid to be supplied to the slewing motor 10, and calculates, on the basis of the second target speed, a target flow rate (a second target flow rate) of the hydraulic fluid to be supplied to the boom cylinder 7 (step S9*a*).

The speed compensation part 54 calculates a total target flow rate being a sum of the first total target flow rate and the second target flow rate (step S10*a*). The total target flow rate indicates a flow rate at which the hydraulic fluid is required to be discharged from the first pump 21 and the second pump 22.

The speed compensation part 54 then calculates a total maximum discharge rate (a maximum dischargeable flow rate) on the basis of: the first discharge pressure detected by the first discharge pressure detector 63 and the second discharge pressure detected by the second discharge pressure detector 64; and a maximum output from the engine 23 determined by the output determination part 55 (step S11*a*). The total maximum discharge rate is a sum of a first maximum discharge rate being a maximum discharge rate of the hydraulic fluid dischargeable by the first pump 21 and a second maximum discharge rate being a maximum discharge rate of the hydraulic fluid dischargeable by the second pump 22.

The speed compensation part 54 determines whether the total target flow rate is equal to or lower than the total maximum discharge rate (step S12*a*). When the total target flow rate is higher than the total maximum discharge rate (NO in step S12), the speed compensation part 54 corrects the first target flow rate and the second target flow rate so that the total target flow rate is equal to or lower than the total maximum discharge rate while keeping a ratio between the first target flow rate and the second target flow rate (step S18).

On the contrary, when the total target flow rate is equal to or lower than the total maximum discharge rate (YES in step S12*a*), the speed compensation part 54 calculates, on the basis of the first actual speed, a flow rate (a first actual flow rate) of the hydraulic fluid actually supplied to the slewing motor 10, and calculates, on the basis of the second actual speed, a flow rate (a second actual flow rate) of the hydraulic fluid actually supplied to the boom cylinder 7 (step S13*a*).

The speed compensation part 54 calculates a total actual flow rate being a sum of the first actual flow rate and the second actual flow rate (step S14*a*). The total actual flow rate is a sum of the hydraulic fluid actually discharged from the first pump 21 and the second pump 22.

The speed compensation part 54 executes a feedback control of regulating the discharge rate of the second pump 22 to reduce the difference between the total actual flow rate and the total target flow rate, thereby allowing the total actual flow rate to approach the total target flow rate. More details will be described below.

The speed compensation part 54 calculates, by using a flow rate difference between the total target flow rate and the total actual flow rate (the total target flow rate−the total actual flow rate) and Equation (4) described below for example, a correction value of the discharge rate (a discharge rate correction value) of the second pump 22 for allowing the flow rate difference to approach zero (step S15*a*).

$$\text{Discharge rate correction value} = \text{proportional gain} \times \text{flow rate difference} + \text{integral gain} \times \text{integrated value of flow rate difference} + \text{derivative gain} \times \text{differential value of flow rate difference} \quad (4)$$

The speed compensation part 54 calculates a discharge rate instructive value by adding the discharge rate correction value to a total target discharge rate at a time immediately before calculation of the discharge rate correction value.

The speed compensation part 54 outputs the discharge rate instructive value (the discharge rate instruction) to the regulator of the second pump 22, and the regulator changes a tilt angle of the second pump 22 so that the discharge rate of the second pump 22 reaches a discharge rate responsive to the discharge rate instructive value. In this way, the discharge rate of the second pump 22 increases to the discharge rate responsive to the discharge rate instructive value (step S16*a*).

The speed compensation part 54 outputs the first opening instructive value to the solenoid proportional pressure reducing valve 34, and the solenoid proportional pressure reducing valve 34 outputs, to the pilot port of the first control valve 31, a pilot pressure for regulating the opening degree of the first control valve 31 to an opening degree responsive to the first opening instructive value. The speed compensation part 54 further outputs the second opening instructive value to the solenoid proportional pressure reducing valve 35, and the solenoid proportional pressure reducing valve 35 outputs, to the pilot port of the second control valve 32, a pilot pressure for regulating the opening degree of the second control valve 32 to an opening degree responsive to the second opening instructive value. The speed compensation part 54 outputs the third opening instructive value to the solenoid proportional pressure reducing valve 36, and the solenoid proportional pressure reducing valve 36 outputs, to the pilot port of the third control valve 33, a pilot pressure for regulating the opening degree of the third control valve 33 to an opening degree responsive to the third opening instructive value (step S17).

Next, the processing from steps S6*b* to S16*b*, S17, and S18 will be described. As described above, when the combined manipulation is not performed (NO in step S4) or the load determination condition is not satisfied (NO in step S5), the controller 50 executes the processing (the second speed compensation control) from steps S6*b* to S16*b*, S17 and S18.

Among steps S6*b* to S16*b*, S17, and S18, the second speed compensation control differs from the first speed compensation control in step S7*b*, step S8*b*, and step S16*b*. In other words, step 6*b* is the same as step 6*a* described above, steps S9*b* to S15*b* are the same as steps S9*a* to S15*a* described above, and step S17 is the same as step 17 described above.

In step S7*b*, the speed compensation part 54 calculates, by using the speed difference (the second target speed−the second actual speed) of the boom cylinder 7 and a preset relational expression, a correction value of the opening degree (the opening amount) of the third control valve 33 for allowing the speed difference of the boom cylinder 7 to approach zero. The correction value calculated in step S7*b* is a correction value for making the opening degree of the third control valve 33 smaller or larger than the third target opening degree.

In step S8*b*, the speed compensation part 54 calculates, by using the speed difference (the second target speed−the second actual speed) of the boom cylinder 7 and a preset relational expression, a correction value of the opening degree (the opening amount) of the second control valve 32 for allowing the speed difference of the boom cylinder 7 to approach zero. The correction value calculated in step S8*b* is a correction value for making the opening degree of the second control valve 32 smaller or larger than the second target opening degree.

In step S16*b*, the speed compensation part 54 outputs a discharge rate instructive value (a discharge rate instruction) to the regulator of the first pump 21, and the regulator changes a tilt angle of the first pump 21 so that the discharge rate of the first pump 21 reaches a discharge rate responsive to the discharge rate instructive value. In this way, the discharge rate of the first pump 21 increases to the discharge rate responsive to the discharge rate instructive value (step S16*b*).

As described heretofore, in the construction machine 100 according to the first embodiment, the speed compensation part 54 calculates a second correction amount so as to be larger as a speed difference between the first target speed determined on the basis of a manipulation amount of the first instructive manipulation and the first actual speed (the first target speed–the first actual speed) becomes larger, and executes the feedback control of regulating the opening degree of the second control valve 32 to an opening degree obtained by subtracting the calculated second correction amount from the second target opening degree. This enables accurate regulation of the rotational speed of the slewing motor 10 to a target rotational speed corresponding to the manipulation amount of the first instructive manipulation even when the first load of the slewing motor 10 is larger than the second load of the boom cylinder 7 in performance of the combined manipulation.

Moreover, in the first embodiment, further execution of the third control valve feedback control of regulating the opening degree of the third control valve 33 on the basis of the speed difference between the second target speed and the second actual speed attains accurate regulation of the second actual speed of the boom cylinder 7 to the second target speed.

In addition, in the first embodiment, further execution of the first control valve feedback control of regulating the opening degree of the first control valve 31 on the basis of the speed difference between the first target speed and the first actual speed succeeds in rapider regulation of the first actual speed of the slewing motor 10 to the first target speed.

Second Embodiment

Figure 5:
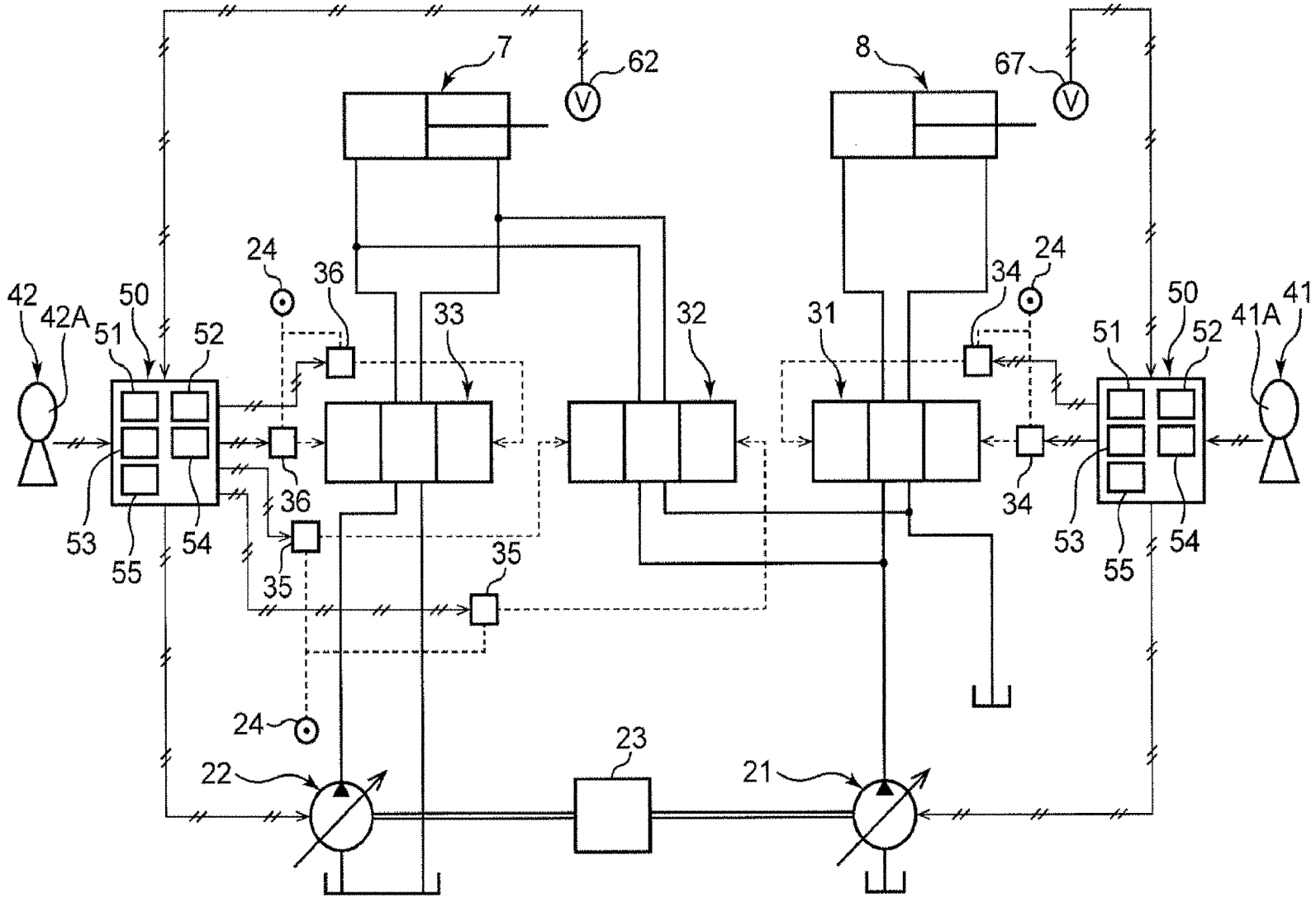
FIG. 5 is a diagram showing a hydraulic circuit of the construction machine according to a second embodiment.

FIG. 5 is a diagram showing a hydraulic circuit of a construction machine 100 according to a second embodiment. As shown in FIG. 5, the second embodiment differs from the first embodiment in a combination of two hydraulic actuators to be subjected to a speed compensation control, and the remaining configurations thereof are equivalent to those of the first embodiment. Therefore, hereinafter, the configuration of the second embodiment different from that of the first embodiment will be mainly described, and the remaining configurations equivalent to those of the first embodiment are given the same signs or numerals as the signs or numerals for the first embodiment in FIG. 5, and the descriptions therefor will be omitted.

Although the combination of the slewing motor 10 (first actuator) and the boom cylinder 7 (second actuator) is subjected to the speed compensation control in the first embodiment, a combination of an arm cylinder 8 (first actuator) and a boom cylinder 7 (second actuator) is subjected to the speed compensation control in the second embodiment.

As shown in FIG. 5, the arm cylinder 8 extends or contracts owing to a supply of hydraulic fluid to be discharged from a first pump 21 to thereby rotate the arm 5 frontward or rearward. The arm cylinder 8 serves as an example of the first actuator.

A first control valve 31 is located between the first pump 21 and the arm cylinder 8, and opens and closes to change a direction and a flow rate of the hydraulic fluid to be supplied from the first pump 21 to the arm cylinder 8. The first control valve 31 is a three-position direction selector valve having a pair of pilot ports, and has a flow rate regulating function of changing the flow rate of the hydraulic fluid by regulating an opening degree (an opening amount) of the first control valve 31 in accordance with a displacement amount of a spool included in the valve or a position of the spool.

A first speed detector 67 is a sensor that detects an extension and contraction speed of the arm cylinder 8.

In the second embodiment, the load determination condition includes a condition that a first actual speed (an extension and contraction speed) of the arm cylinder 8 detected by the first speed detector 67 is lower than a first target speed of the arm cylinder 8. A condition determination part 53 determines that the determination condition is satisfied when the first actual speed is lower than the first target speed.

A control executed by a controller 50 in the second embodiment may proceed along the flowchart shown in FIG. 3 and FIG. 4 in the same manner as in the first embodiment. Specifically, the control according to the second embodiment is equivalent to the control according to the first embodiment except that the arm cylinder 8 serves as the first actuator in the flowchart in FIG. 3 and FIG. 4.

Third Embodiment

A construction machine 100 according to a third embodiment differs from that according to each of the first embodiment and the second embodiment in including a detector that actually detects a first load of a first actuator and a detector that actually detects a second load of a second actuator. The remaining configurations in the third modification are equivalent to those in the first embodiment and the second embodiment.

Specifically, the construction machine 100 according to the third embodiment further includes a first load detector that detects a first load and a second load detector that detects a second load. The load determination condition includes a condition that the first load detected by the first load detector is larger than the second load detected by the second load detector. The first load detector is a pressure sensor that detects a pressure of hydraulic fluid discharged from a first pump 21, and the second load detector is a pressure sensor that detects a pressure of hydraulic fluid discharged from a second pump 22. The first load detector may include, for example, a pressure sensor 63 provided at a hydraulic pressure pipe connecting the first pump 21 and a first control valve 31 to each other in the hydraulic circuit shown in FIG. 2. The first load detector may include, for example, a differential pressure sensor 65 (a pair of pressure sensors 65A, 65B) for detecting a differential pressure of a slewing motor 10. The second load detector may include, for example, a pressure sensor 64 provided at a hydraulic pressure pipe connecting the second pump 22 and a third control valve 33 to each other. The second load detector may include, for example, a pressure sensor 66 provided at a pipe connecting the third control valve 33 and a head chamber of a boom cylinder 7 to each other. It is noted here that the construction machine 100 according to each of the first embodiment and the second embodiment may not include the first load detector and the second load detector.

In the third embodiment, a condition determination part 53 can determine whether the load determination condition is satisfied by comparing the first load actually detected by the first load detector and the second load actually detected by the second load detector with each other.

MODIFICATIONS

Among the steps shown in the flowchart in FIG. 3 and FIG. 4, steps S6*a* to S8*a* and S6*b* to S8*b* are intended for processing (valve processing) of controlling the first to third control valves 31 to 33, and steps S9*a* to S16*a* and steps 9*b* to 16*b* are intended for processing (pump processing) of controlling the first and second pumps 21, 22. Although the pump processing is executed after the valve processing in FIG. 3, the execution order is not limited to this aspect.

Figure 6:
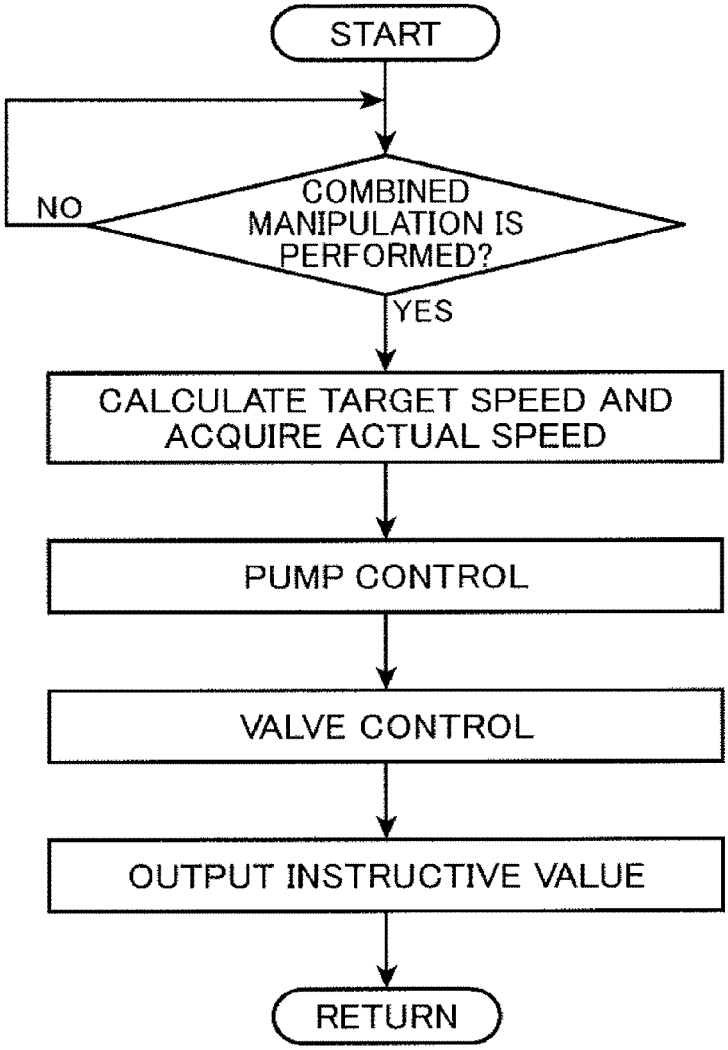
FIG. 6 is a flowchart showing a process executed by a controller included in a construction machine according to a first modification.
Figure 7:
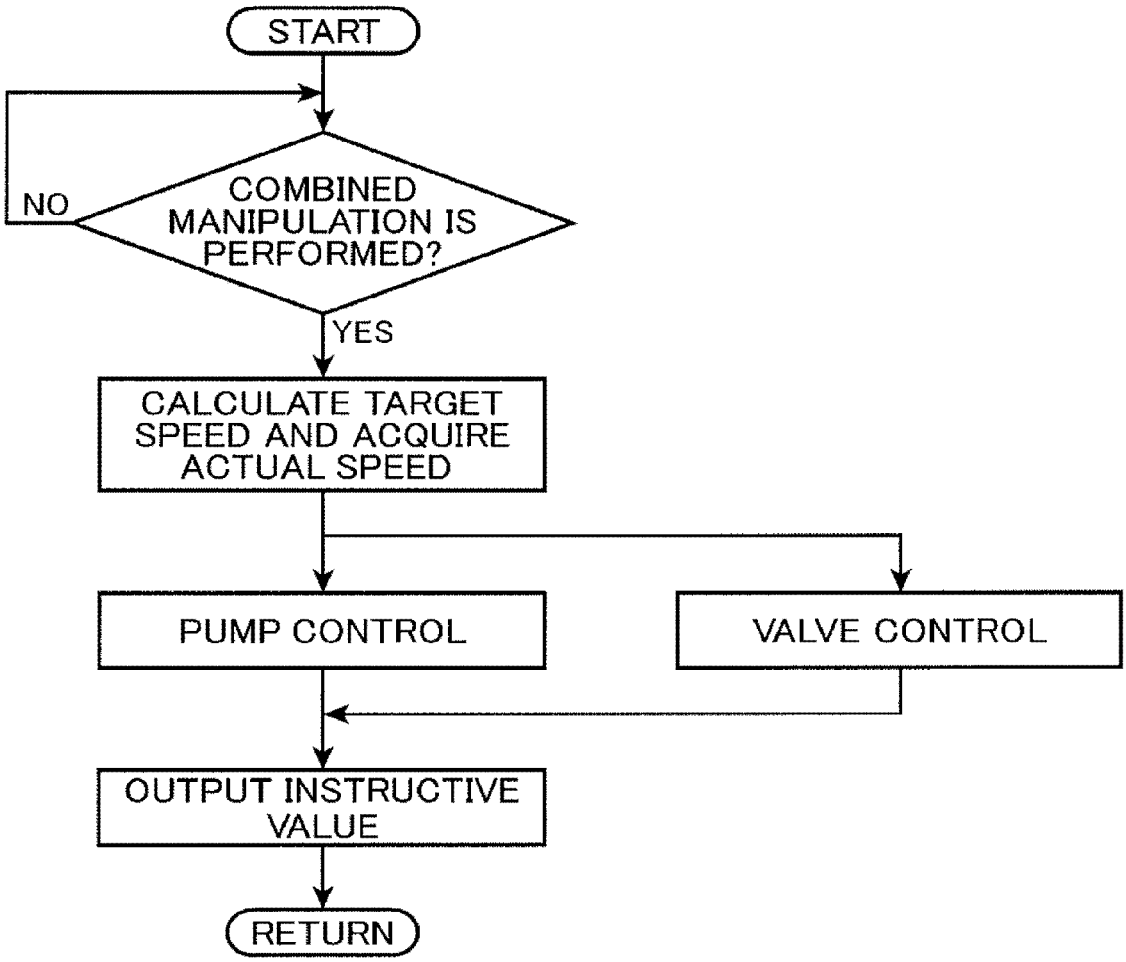
FIG. 7 is a flowchart showing a process executed by a controller included in a construction machine according to a second modification.

For instance, the pump control may be executed before the valve control as shown in a first modification in FIG. 6, or the valve control and the pump control may be parallelly executed as shown in a second modification in FIG. 7.

Figure 8:
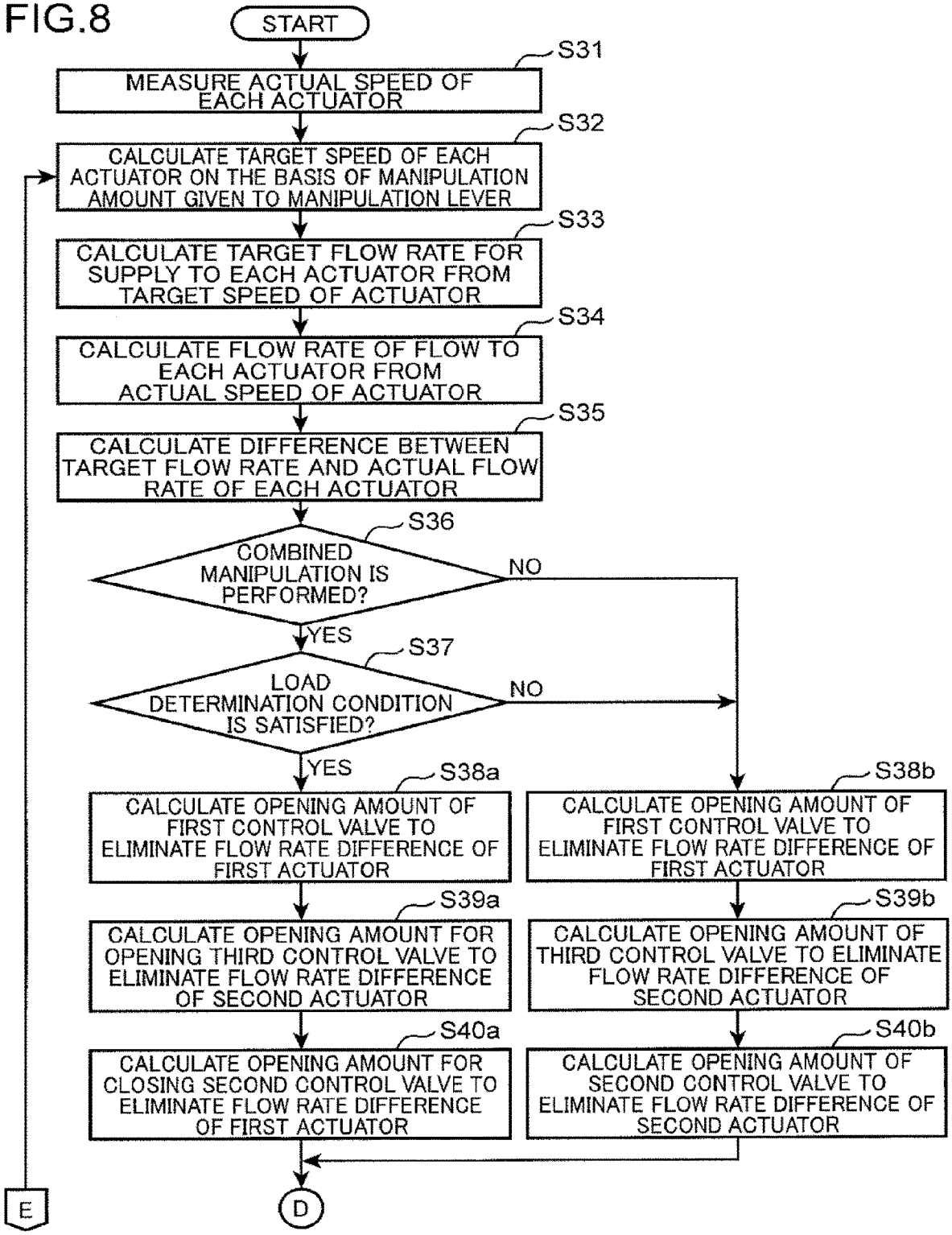
FIG. 8 is a flowchart showing a process executed by a controller included in a construction machine according to a third modification.
Figure 9:
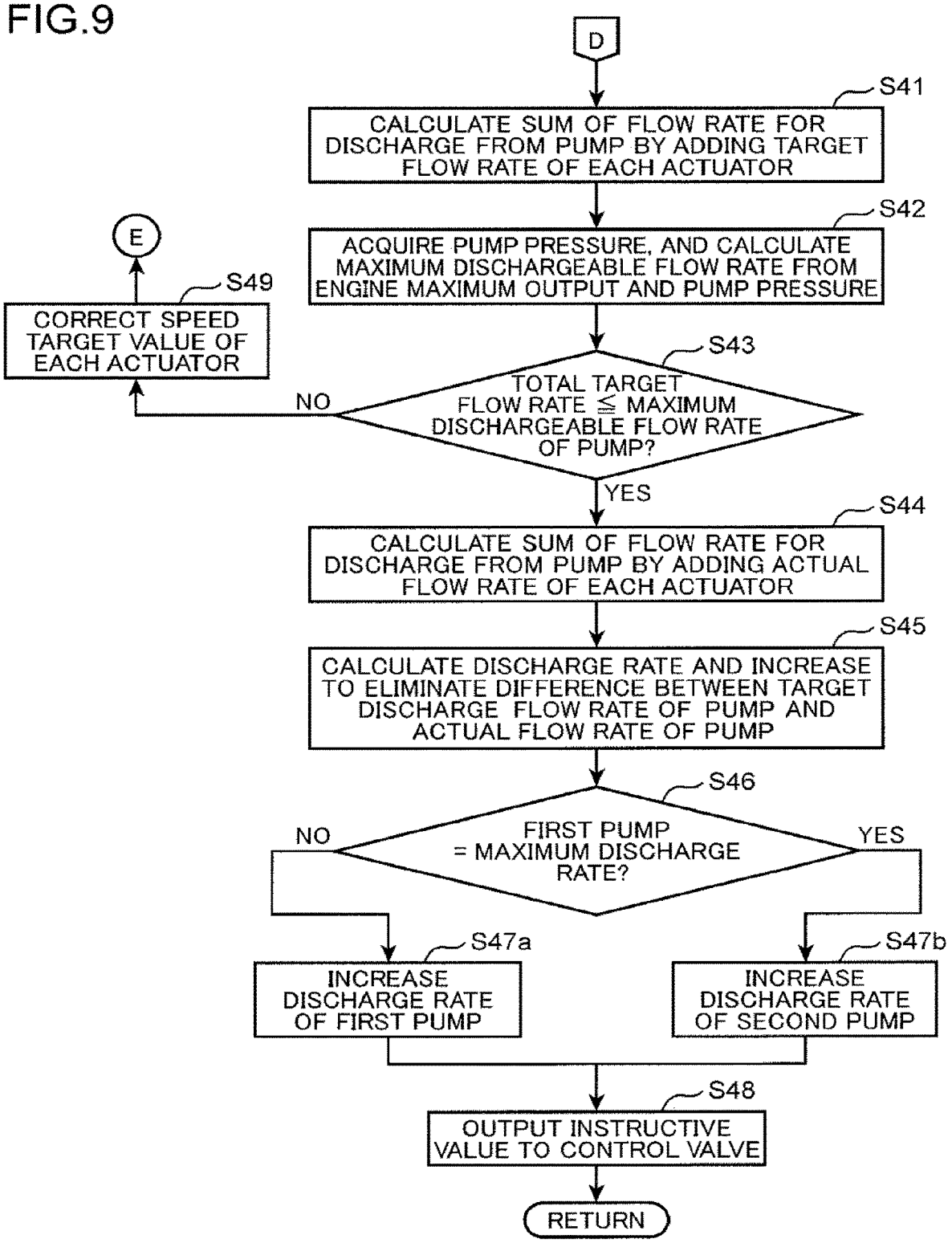
FIG. 9 is the flowchart showing the process executed by the controller of the construction machine according to the third modification.

FIG. 8 and FIG. 9 indicate a flowchart showing a process executed by a controller 50 included in a construction machine 100 according to a third modification. Although FIG. 8 and FIG. 9 are of the two drawings in separation as a matter of convenience, the flowchart shown in FIG. 8 and FIG. 9 illustrates a series of control steps.

A control according to the third modification shown in FIG. 8 and FIG. 9 differs from the control shown in FIG. 3 and FIG. 4 in conversion of a speed to a flow rate of hydraulic fluid, but an entire sequence of the control is similar to the sequence of the control shown in FIG. 3 and FIG. 4. The control according to the third modification is applicable to both the first embodiment and the second embodiment. The third modification will be described in more detail below.

First, a signal corresponding to a detection value detected by each of the first speed detector 61, the second speed detector 62, the first discharge pressure detector 63, the second discharge pressure detector 64, and the differential pressure detector 65 is input to the controller 50 (step S31).

Subsequently, the controller 50 determines a first target speed and a second target speed in the same manner as in step S2 (step S32).

The speed compensation part 54 calculates, on the basis of the first target speed, a target flow rate (a first target flow rate) of hydraulic fluid to be supplied to an arm cylinder 8, and calculates, on the basis of the second target speed, a target flow rate (a second target flow rate) of hydraulic fluid to be supplied to a boom cylinder 7 (step S33).

The speed compensation part 54 calculates, on the basis of the first actual speed, a flow rate (a first actual flow rate) of the hydraulic fluid actually supplied to the arm cylinder 8, and calculates, on the basis of the second actual speed, a flow rate (a second actual flow rate) of the hydraulic fluid actually supplied to the boom cylinder 7 (step S34).

The speed compensation part 54 calculates a flow rate difference of the arm cylinder 8 that is a difference between the first target flow rate and the first actual flow rate (the first target flow rate−the first actual flow rate), and calculates a flow rate difference of the boom cylinder 7 that is a difference between the second target flow rate and the second actual flow rate (the second target flow rate−the second actual flow rate) (step S35).

Then, the speed compensation part 54 determines, on the basis of the first instruction signal and the second instruction signal, whether the combined manipulation is performed (step S36). When the combined manipulation is performed (YES in step S36), the condition determination part 53 determines whether the load determination condition is satisfied (step S37).

When the load determination condition is satisfied (YES in step S37), the controller 50 executes processing (a first speed compensation control) from steps S38*a* to S40*a* and steps S41 to S49. The first speed compensation control corresponds to the speed compensation control of the present disclosure. On the contrary, when the combined manipulation is not performed (NO in step S36) or the load determination condition is not satisfied (NO in step S37), the controller 50 executes processing (a second speed compensation control) from steps S38*b* to S40*b* and steps S41 to S49.

In the first speed compensation control from steps S38*a* to S40*a* and steps S41 to S49, the speed compensation part 54 executes a feedback control of regulating an opening degree of a first control valve 31 for allowing a speed difference of the arm cylinder 8 to approach zero, executes a feedback control of regulating an opening degree of a second control valve 32 for allowing the speed difference of the arm cylinder 8 to approach zero, and executes a feedback control of regulating an opening degree of a third control valve 33 for allowing a speed difference of the boom cylinder 7 to approach zero. More details will be described below.

The speed compensation part 54 calculates, by using the flow rate difference (the first target flow rate−the first actual flow rate) of the arm cylinder 8 and Equation (5) described below for example, a correction value (a first correction value) of the opening degree (the opening amount) of the first control valve 31 for allowing the flow rate difference of the arm cylinder 8 to approach zero (step S38*a*). The first correction value calculated in step S38*a* is a correction value for making the opening degree of the first control valve 31 larger than the first target opening degree. The speed compensation part 54 calculates a first opening instructive value obtained through correction of adding the first correction amount to the first target opening degree.

$$\text{First correction value}=\text{proportional gain}\times\text{flow rate difference}+\text{integral gain}\times\text{integrated value of flow rate difference}+\text{derivative gain}\times\text{differential value of flow rate difference} \quad (5)$$

The speed compensation part 54 calculates, by using the flow rate difference (the second target flow rate−the second actual flow rate) of the boom cylinder 7 and Equation (6) described below for example, a correction value (a third correction value) of the opening degree (the opening amount) of the third control valve 33 for allowing the flow rate difference of the boom cylinder 7 to approach zero (step S39*a*). The third correction value calculated in step S39*a* is a correction value for making the opening degree of the third control valve 33 larger than the third target opening degree. The speed compensation part 54 calculates a third opening instructive value obtained through correction of adding the third correction amount to the third target opening degree.

$$\text{Third correction value}=\text{proportional gain}\times\text{flow rate difference}+\text{integral gain}\times\text{integrated value of flow rate difference}+\text{derivative gain}\times\text{differential value of flow rate difference} \quad (6)$$

The speed compensation part 54 calculates, by using the flow rate difference (the first target flow rate−the first actual flow rate) of the arm cylinder 8 and Equation (7) described below for example, a correction value (a second correction value) of the opening degree (the opening amount) of the second control valve 32 for allowing the flow rate difference of the arm cylinder 8 to approach zero (step S40*a*). The second correction value calculated in step S40*a* is a correction value for making the opening degree of the second control valve 32 smaller than the second target opening degree. The speed compensation part 54 calculates a second opening instructive value obtained through correction of subtracting the second correction amount from the second target opening degree.

$$\text{Second correction value}=\text{proportional gain}\times\text{flow rate difference}+\text{integral gain}\times\text{integrated value of flow rate difference}+\text{derivative gain}\times\text{differential value of flow rate difference} \quad (7)$$

Subsequently, the speed compensation part 54 calculates a total target flow rate being a sum of the first total target flow rate and the second target flow rate (step S41). The total target flow rate indicates a flow rate at which the hydraulic fluid is required to be discharged from a first pump 21 and a second pump 22.

The speed compensation part 54 then calculates a total maximum discharge rate (a maximum dischargeable flow rate) on the basis of: a first discharge pressure detected by a first discharge pressure detector 63 and a second discharge pressure detected by a second discharge pressure detector 64; and a maximum output from an engine 23 determined by an output determination part 55 (step S42). The total maximum discharge rate is a sum of a first maximum discharge rate being a maximum discharge rate of the hydraulic fluid dischargeable by the first pump 21 and a second maximum discharge rate being a maximum discharge rate of the hydraulic fluid dischargeable by the second pump 22.

The speed compensation part 54 determines whether the total target flow rate is equal to or lower than the total maximum discharge rate (step S43). When the total target flow rate is higher than the total maximum discharge rate (NO in step S43), the speed compensation part 54 corrects the first target flow rate and the second target flow rate so that the total target flow rate is equal to or lower than the total maximum discharge rate while keeping a ratio between the first target flow rate and the second target flow rate (step S49).

On the contrary, when the total target flow rate is equal to or lower than the total maximum discharge rate (YES in step S43), the speed compensation part 54 calculates a total actual flow rate being a sum of the first actual flow rate and the second actual flow rate (step S44). The total actual flow rate is a sum of the hydraulic fluid actually discharged from the first pump 21 and the second pump 22.

The speed compensation part 54 executes a feedback control of regulating the discharge rate of the first pump 21 or the discharge rate of the second pump 22 to reduce the difference between the total actual flow rate and the total target flow rate, thereby causing the total actual flow rate to approach the total target flow rate. More details will be described below.

The speed compensation part 54 calculates, by using a flow rate difference between the total target flow rate and the total actual flow rate (the total target flow rate−the total actual flow rate) and Equation (8) described below for example, a correction value of the discharge rate (a discharge rate correction value) of the first pump 21 or the second pump 22 for allowing the flow rate difference to approach zero (step S45).

$$\text{Discharge rate correction value} = \text{proportional gain} \times \text{flow rate difference} + \text{integral gain} \times \text{integrated value of flow rate difference} + \text{derivative gain} \times \text{differential value of flow rate difference} \quad (8)$$

The speed compensation part 54 calculates a discharge rate instructive value by adding the discharge rate correction value to a total target discharge rate at a time immediately before calculation of the discharge rate correction value.

Then, the speed compensation part 54 determines whether the discharge rate of the first pump 21 reaches the maximum discharge rate of the first pump 21 (step S46). When the discharge rate of the first pump 21 reaches the maximum discharge rate of the first pump 21 (YES in step S46), the speed compensation part 54 outputs a discharge rate instructive value (a discharge rate instruction) to a regulator included in the second pump 22, and the regulator changes a tilt angle of the second pump 22 so that the discharge rate of the second pump 22 reaches a discharge rate responsive to the discharge rate instructive value. In this way, the discharge rate of the first pump 22 increases to the discharge rate responsive to the discharge rate instructive value (step S47*b*).

On the contrary, when the discharge rate of the first pump 21 does not reach the maximum discharge rate of the first pump 21 (No in step S46), the speed compensation part 54 outputs a discharge rate instructive value (a discharge rate instruction) to a regulator included in the first pump 21, and the regulator changes a tilt angle of the first pump 21 so that the discharge rate of the first pump 21 reaches a discharge rate responsive to the discharge rate instructive value. In this way, the discharge rate of the first pump 21 increases to the discharge rate responsive to the discharge rate instructive value (step S47*a*).

The speed compensation part 54 outputs the first opening instructive value to a solenoid proportional pressure reducing valve 34, and the solenoid proportional pressure reducing valve 34 outputs, to a pilot port of the first control valve 31, a pilot pressure for regulating the opening degree of the first control valve 31 to an opening degree responsive to the first opening instructive value. The speed compensation part 54 further outputs the second opening instructive value to a solenoid proportional pressure reducing valve 35, and the solenoid proportional pressure reducing valve 35 outputs, to a pilot port of the second control valve 32, a pilot pressure for regulating the opening degree of the second control valve 32 to an opening degree responsive to the second opening instructive value. The speed compensation part 54 outputs the third opening instructive value to a solenoid proportional pressure reducing valve 36, and the solenoid proportional pressure reducing valve 36 outputs, to a pilot port of the third control valve 33, a pilot pressure for regulating the opening degree of the third control valve 33 to an opening degree responsive to the third opening instructive value (step S48).

Next, the second speed compensation control from steps S38*b* to S40*b* and steps S41 to S49 will be described. As described above, when the combined manipulation is not performed (NO in step S36) or the load determination condition is not satisfied (NO in step S37), the controller 50 executes the processing (the second speed compensation control) from steps S38*b* to S40*b* and steps S41 to S49.

Among steps S38*b* to S40*b*, the second speed compensation control differs from the first speed compensation control in step S39*b* and step S40*b*. The remaining steps of the second speed compensation control are equivalent to those of the first speed compensation control.

In step S39*b*, the speed compensation part 54 calculates, by using the flow rate difference (the second target speed−the second actual speed) of the boom cylinder 7 and a preset relational expression, a correction value of the opening degree (the opening amount) of the third control valve 33 for allowing the flow rate difference of the boom cylinder 7 to approach zero. The correction value calculated in step S39*b* is a correction value for making the opening degree of the third control valve 33 smaller or larger than the third target opening degree.

In step S40*b*, the speed compensation part 54 calculates, by using the flow rate difference (the second target flow rate−the second actual flow rate) of the boom cylinder 7 and a preset relational expression, a correction value of the opening degree (the opening amount) of the second control valve 32 for allowing the flow rate difference of the boom cylinder 7 to approach zero. The correction value calculated in step S40*b* is a correction value for making the opening degree of the second control valve 32 smaller or larger than the second target opening degree.

As described above, the construction machine 100 according to the second embodiment calculates a second correction amount for regulating the opening degree of the second control valve 32 by using a target flow rate and an actual flow rate respectively highly correlated with a target speed and an actual speed of the actuator. Even in the second embodiment, the speed compensation part 54 calculates the second correction amount so as to be larger as the speed difference between the first target speed determined on the basis of a manipulation amount of the first instructive manipulation and the first actual speed becomes larger, and executes the feedback control of regulating the opening degree of the second control valve 32 to an opening degree obtained by subtracting the calculated second correction amount from the second target opening degree. This enables accurate regulation of the actual speed of the arm cylinder 8 to the first target speed corresponding to the manipulation amount of the first instructive manipulation even when the first load of the arm cylinder 8 is larger than the second load of the boom cylinder 7 in performance of the combined manipulation.

In the second embodiment, such a situation where the first load is larger than the second load in performance of the combined manipulation is presumably seen in, for example, a case of performance of a combined manipulation of giving a manipulation for a boom rising operation and giving a manipulation for an arm pushing operation at the same time.

Moreover, in the second embodiment, a third correction amount for regulating the opening degree of the third control valve 33 is calculated by using the second target flow rate and the second actual flow rate, a first correction amount for regulating the opening degree of the first control valve 31 is calculated by using the first target flow rate and the first actual flow rate, and the third control valve feedback control and the first control valve feedback control are further executed. This consequently achieves accurate regulation of the second actual speed of the boom cylinder 7 to the second target speed, and succeeds in rapider regulation of the first actual speed of the arm cylinder 8 to the first target speed.

In the speed compensation control, closing the second control valve 32 is more preferable, rather than making the opening degree of the second control valve 32 smaller than the second target opening degree, in use of the discharge rate of the first pump 21 solely for the first actuator. The closing of the second control valve 32 disconnects the first pump 21 and the second actuator from each other. Hence, a working pressure of the second actuator has no influence on a working pressure of the first actuator. A configuration covering the flow rate of the second actuator with the second pump 22 and including the first actuator in the form of a hydraulic motor or a slewing motor more easily ensures the working pressure of the hydraulic motor, and thus allows the first actual speed to more rapidly approach the first target speed.

The present disclosure should not be limited to the embodiments described above. The disclosure includes, for example, aspects to be described below.

(A) Combination of Two Hydraulic Actuators to be Subjected to Speed Compensation Control Although the combination of the slewing motor and the boom cylinder is subjected to the speed compensation control in the first embodiment, and the combination of the arm cylinder and the boom cylinder is subjected to the speed compensation control in the second embodiment, the combination is not limited thereto. A combination of two hydraulic actuators to be subjected to the speed compensation control may be any combination of two hydraulic actuators as well as the combination seen in each of the first embodiment and the second embodiment.

(B) Hydraulic Pump

Although each of the first pump 21 and the second pump 22 is a variable displacement hydraulic pump in the embodiments, the first pump 21 may be a fixed displacement hydraulic pump in a configuration where the speed compensation control excludes: making the opening degree of the first control valve 31 larger than the first target opening degree; and regulating the opening degree of the first control valve 31.

Conclusively, this disclosure provides a construction machine which enables accurate regulation of an actual speed of a first actuator to a target speed even when a load of the first actuator is larger than a load of a second actuator in performance of a combined manipulation.

Provided is a construction machine including: a first pump being a variable displacement hydraulic pump for discharging hydraulic fluid; a second pump being a variable displacement hydraulic pump for discharging hydraulic fluid; a first actuator that receives a supply of the hydraulic fluid discharged from the first pump to come into operation; a second actuator that receives a supply of the hydraulic fluid discharged from the second pump to come into operation; a first control valve that is located between the first pump and the first actuator, and opens and closes to change a flow rate of the hydraulic fluid to be supplied from the first pump to the first actuator; a second control valve that is located between the first pump and the second actuator, and opens and closes to change a flow rate of the hydraulic fluid to be supplied from the first pump to the second actuator; a third control valve that is located between the second pump and the second actuator, and opens and closes to change a flow rate of the hydraulic fluid to be supplied from the second pump to the second actuator; a first manipulation device that receives a first instructive manipulation for instructing an operation of the first actuator; a second manipulation device that receives a second instructive manipulation for instructing an operation of the second actuator; a pump control part that regulates a discharge rate of the first pump and a discharge rate of the second pump so that the hydraulic fluid is discharged at a total target flow rate from at least one of the first pump and the second pump, the total target flow rate being a sum of a first target flow rate which is a target flow rate of the hydraulic fluid to the first actuator and determined on the basis of a manipulation amount of the first instructive manipulation and a second target flow rate which is a target flow rate of the hydraulic fluid to the second actuator and determined on the basis of a manipulation amount of the second instructive manipulation; a valve control part that regulates an opening degree of the first control valve to a first target opening degree determined on the basis of the first target flow rate, regulates an opening degree of the second control vale to a second target opening degree determined on the basis of a second control valve target flow rate which is a target flow rate of the hydraulic fluid to the second actuator via the second control valve and a part of the second target flow rate, and regulates an opening degree of the third control valve to a third target opening degree determined on the basis of a third control valve target flow rate which is a target flow rate of the hydraulic fluid to the second actuator via the third control valve and a part of the second target flow rate; a condition determination part that determines whether a preset load determination condition is satisfied, the load determination condition being a condition to determine that a first load being a load of the first actuator is larger than a second load being a load of the second actuator; and a speed compensation part that executes a feedback control of regulating the opening degree of the second control valve to an opening degree obtained by subtracting a correction amount (a second correction value) from the second target opening degree, the correction amount (the second correction value) being calculated by the speed compensation part so as to be larger as a speed difference between a first target speed which is a target speed of the first actuator and determined on the basis of the manipulation amount of the first instructive manipulation and a first actual speed which is an actual speed of the first actuator becomes larger, when a combined manipulation of giving the first instructive manipulation to the first manipulation device and giving the second instructive manipulation to the second manipulation device is performed and the condition determination part determines that the load determination condition is satisfied.

In the construction machine, the speed compensation part calculates a correction amount so as to be larger as a speed difference (the first target speed−the first actual speed) between the first target speed determined on the basis of a manipulation amount of the first instructive manipulation and the first actual speed becomes larger, and executes the feedback control of regulating the opening degree of the second control valve to an opening degree obtained by subtracting the calculated correction amount from the second target opening degree. This enables accurate regulation of the first actual speed of the first actuator to the first target speed corresponding to the manipulation amount of the first instructive manipulation even when the first load of the first actuator is larger than the second load of the second actuator in performance of the combined manipulation.

In the feedback control, the speed compensation part may actually calculate the speed difference between the first target speed and the first actual speed and calculate a correction amount so as to be larger as the calculated speed difference becomes larger, or the speed compensation part may calculate a difference between a physical quantity corresponding to the first target speed and a physical quantity corresponding to the first actual speed and calculate a correction amount so as to be larger as the calculated difference becomes larger. Examples of the physical quantity corresponding to the first target speed include a first target flow rate being a target flow rate of the hydraulic fluid to the first actuator. The first target flow rate is determined on the basis of the manipulation amount of the first instructive manipulation, and indicates a value highly correlated with the first target speed. Examples of the physical quantity corresponding to the first actual speed include a first actual flow rate being an actual flow rate of the hydraulic fluid supplied to the first actuator. The first actual flow rate indicates a value highly correlated with the first actual speed.

The construction machine preferably further includes a first detector that detects the first actual speed or a physical quantity corresponding to the first actual speed. The load determination condition preferably includes a condition that the first actual speed or the physical quantity detected by the first detector is lower than the first target speed or smaller than a physical quantity corresponding to the first target speed. In this case, even in the construction machine without detectors respectively for actually detecting the first load and the second load, the condition determination part can determine whether the load determination condition is satisfied. More details will be described below.

When the first load is larger than the second load in performance of the combined manipulation, the hydraulic fluid discharged from the first pump disproportionately flows to the second actuator, and thus, the first actual speed of the first actuator is lower than the first target speed. That is to say, the larger first load than the second load correlates with the lower first actual speed than the first target speed. Therefore, even in the construction machine without detectors respectively for actually detecting the first load and the second load, the condition determination part can determine whether the load determination condition is satisfied by determining whether the first actual speed or a physical quantity corresponding to the first actual speed detected by the first detector is lower than the first target speed or smaller than a physical quantity corresponding to the first target speed.

Specifically, when the first detector serves as a speed detector that detects the first actual speed, the condition determination part can determine whether the load determination condition is satisfied by determining whether the first actual speed detected by the first detector is lower than the first target speed. Alternatively, when the first detector serves as a detector that detects a physical quantity corresponding to the first actual speed, the condition determination part can determine whether the load determination condition is satisfied by determining whether the physical quantity detected by the first detector is smaller than the physical quantity corresponding to the first target speed. When the physical quantity corresponding to the first actual speed indicates, for example, the first actual flow rate being an actual flow rate of the hydraulic fluid to the first actuator, the first detector serves as a flow rate detector that detects the first actual flow rate.

The first actuator preferably includes a slewing motor being a hydraulic motor for slewing an upper slewing body included in the construction machine and configured to slew. The first actual speed is preferably a rotational speed of the slewing motor. The first target speed is preferably a target rotational speed of the slewing motor. For instance, in a slewing-type construction machine like a hydraulic excavator, the load of the slewing motor serving as the first actuator is larger than the load of the second actuator (e.g., the boom cylinder, the arm cylinder, the bucket cylinder) in acceleration of the rotation of the slewing motor, in particular, at starting of the slewing motor. At this time, the hydraulic fluid discharged from the first pump unproportionally flows to the second actuator, and thus, the first actual speed becomes lower than the first target speed. Consequently, the condition determination part can determine that the load determination condition is satisfied when the rotational speed of the slewing motor as the first actual speed is lower than the target rotational speed of the slewing motor as the first target speed, and the speed compensation part can execute the feedback control on the basis of a result of the determination by the condition determination part.

The construction machine may further include: a first load detector that detects the first load; and a second load detector that detects the second load. The load determination condition may include a condition that the first load detected by the first load detector is larger than the second load detected by the second load detector. In this aspect, the condition determination part can determine whether the load determination condition is satisfied by comparing the actually detected first load and second load with each other.

In the construction machine, the speed compensation part preferably further executes a feedback control of regulating the opening degree of the third control valve to an opening degree obtained by adding a correction amount (a third correction value) to the third target opening degree, the correction amount (the third correction value) being calculated by the speed compensation part so as to be larger as a speed difference between a second target speed which is a target speed of the second actuator and determined on the basis of the manipulation amount of the second instructive manipulation and a second actual speed which is an actual speed of the second actuator becomes larger, when the combined manipulation is performed and the condition determination part determines that the load determination condition is satisfied. In this aspect, further execution of the feedback control of regulating the opening degree of the third control valve on the basis of the speed difference between the second target speed and the second actual speed achieves accurate regulation of the second actual speed of the second actuator to the second target speed.

In the construction machine, the speed compensation part preferably further executes a feedback control of regulating the opening degree of the first control valve to an opening degree obtained by adding a correction amount (a first correction value) to the first target opening degree, the correction amount (the first correction value) being calculated by the speed compensation part so as to be larger as the speed difference between the first target speed and the first actual speed becomes larger, when the combined manipulation is performed and the condition determination part determines that the load determination condition is satisfied. In this aspect, further execution of the feedback control of regulating the opening degree of the first control valve on the basis of the speed difference between the first target speed and the first actual speed succeeds in rapider regulation of the first actual speed of the first actuator to the first target speed.

In the construction machine, the speed compensation part preferably further executes a feedback control of regulating, on the basis of a correction amount (a discharge rate correction value), the discharge rate of at least one of the first pump and the second pump, the correction amount (the discharge rate correction value) being calculated by the speed compensation part so as to be larger as a flow rate difference between the total target flow rate and a total actual flow rate becomes larger, the total actual flow rate being calculated by the speed compensation part and being a sum of a first actual flow rate which is an actual flow rate of the hydraulic fluid supplied to the first actuator and a second actual flow rate which is an actual flow rate of the hydraulic fluid to be supplied to the second actuator, when the combined manipulation is performed and the condition determination part determines that the load determination condition is satisfied. In this aspect, execution of the feedback control of regulating the discharge rate of at least one of the first pump and the second pump on the basis of the flow rate difference between the total target flow rate and the total actual flow rate achieves accurate regulation of the total actual flow rate to the total target flow rate.

In the construction machine, when the total target flow rate calculated by the speed compensation part is higher than a total maximum discharge rate being a sum of a first maximum discharge rate which is a maximum discharge rate of the hydraulic fluid dischargeable from the first pump and a second maximum discharge rate which is a maximum discharge rate of the hydraulic fluid dischargeable from the second pump, the speed compensation part preferably corrects the first target flow rate and the second target flow rate so that the total target flow rate is equal to or lower than the total maximum discharge rate while keeping a ratio between the first target flow rate and the second target flow rate. This aspect enables a setting of the total discharge rate of the discharge rate of the first pump and the discharge rate of the second pump to the total maximum discharge rate or lower while keeping a balance between the speed of the first actuator corresponding to the manipulation amount of the first instruction manipulation and the speed of the second actuator corresponding to the manipulation amount of the second instructive manipulation.

The construction machine preferably further includes: a first discharge pressure detector that detects a first discharge pressure being a discharge pressure of the hydraulic fluid from the first pump; a second discharge pressure detector that detects a second discharge pressure being a discharge pressure of the hydraulic fluid from the second pump; an engine that drives the first pump and the second pump; and an output determination part that determines an output from the engine. The speed compensation part preferably calculates the total maximum discharge rate, on the basis of the output from the engine, and the first discharge pressure and the second discharge pressure. This aspect can give a restriction on the discharge rate of each of the first pump and the second pump on the basis of the output from the engine, and the first discharge pressure and the second discharge pressure, and accordingly attains compensation for the speed of each of the first actuator and the second actuator without an excessive load to the engine.

The invention claimed is:

1. A construction machine, comprising:

a first pump being a variable displacement hydraulic pump for discharging hydraulic fluid;

a second pump being a variable displacement hydraulic pump for discharging hydraulic fluid;

a first actuator that receives a supply of the hydraulic fluid discharged from the first pump to come into operation;

a second actuator that receives a supply of the hydraulic fluid discharged from the second pump to come into operation;

a first control valve that is located between the first pump and the first actuator, and opens and closes to change a flow rate of the hydraulic fluid to be supplied from the first pump to the first actuator;

a second control valve that is located between the first pump and the second actuator, and opens and closes to change a flow rate of the hydraulic fluid to be supplied from the first pump to the second actuator;

a third control valve that is located between the second pump and the second actuator, and opens and closes to change a flow rate of the hydraulic fluid to be supplied from the second pump to the second actuator;

a first manipulation device that receives a first instructive manipulation for instructing an operation of the first actuator;

a second manipulation device that receives a second instructive manipulation for instructing an operation of the second actuator;

a pump control part that regulates a discharge rate of the first pump and a discharge rate of the second pump so that the hydraulic fluid is discharged at a total target flow rate from at least one of the first pump and the second pump, the total target flow rate being a sum of a first target flow rate which is a target flow rate of the hydraulic fluid to the first actuator and determined on the basis of a manipulation amount of the first instructive manipulation and a second target flow rate which is a target flow rate of the hydraulic fluid to the second actuator and determined on the basis of a manipulation amount of the second instructive manipulation;

a valve control part that regulates an opening degree of the first control valve to a first target opening degree determined on the basis of the first target flow rate, regulates an opening degree of the second control vale to a second target opening degree determined on the basis of a second control valve target flow rate which is a target flow rate of the hydraulic fluid to the second actuator via the second control valve and a part of the second target flow rate, and regulates an opening degree of the third control valve to a third target opening degree determined on the basis of a third control valve target flow rate which is a target flow rate of the hydraulic fluid to the second actuator via the third control valve and a part of the second target flow rate;

a condition determination part that determines whether a preset load determination condition is satisfied, the load determination condition being a condition to determine that a first load being a load of the first actuator is larger than a second load being a load of the second actuator; and a speed compensation part that executes a feedback control of regulating the opening degree of the second control valve to an opening degree obtained by subtracting a correction amount from the second target opening degree, when a combined manipulation of giving the first instructive manipulation to the first manipulation device and giving the second instructive manipulation to the second manipulation device is performed and the condition determination part determines that the load determination condition is satisfied, the correction amount being calculated by the speed compensation part so as to be larger as a speed difference between a first target speed and a first actual speed becomes larger, the first target speed being a target speed of the first actuator and determined on the basis of the manipulation amount of the first instructive manipulation, the first actual speed being an actual speed of the first actuator.

2. The construction machine according to claim 1, further comprising a first detector that detects the first actual speed or a physical quantity corresponding to the first actual speed, wherein the load determination condition includes a condition that the first actual speed or the physical quantity detected by the first detector is lower than the first target speed or smaller than a physical quantity corresponding to the first target speed.

3. The construction machine according to claim 2, wherein the first actuator includes a slewing motor being a hydraulic motor for slewing an upper slewing body included in the construction machine and configured to slew, the first actual speed is a rotational speed of the slewing motor, and the first target speed is a target rotational speed of the slewing motor.

4. The construction machine according to claim 1, further comprising:

a first load detector that detects the first load; and a second load detector that detects the second load, wherein the load determination condition includes a condition that the first load detected by the first load detector is larger than the second load detected by the second load detector.

5. The construction machine according to claim 1, wherein the speed compensation part further executes a feedback control of regulating the opening degree of the third control valve to an opening degree obtained by adding a correction amount to the third target opening degree, the correction amount being calculated by the speed compensation part so as to be larger as a speed difference between a second target speed which is a target speed of the second actuator and determined on the basis of the manipulation amount of the second instructive manipulation and a second actual speed which is an actual speed of the second actuator becomes larger, when the combined manipulation is performed and the condition determination part determines that the load determination condition is satisfied.

6. The construction machine according to claim 1, wherein the speed compensation part further executes a feedback control of regulating the opening degree of the first control valve to an opening degree obtained by adding a correction amount to the first target opening degree, the correction amount being calculated by the speed compensation part so as to be larger as the speed difference between the first target speed and the first actual speed becomes larger, when the combined manipulation is performed and the condition determination part determines that the load determination condition is satisfied.

7. The construction machine according to claim 1, wherein the speed compensation part further executes a feedback control of regulating, on the basis of a correction amount, the discharge rate of at least one of the first pump and the second pump, the correction amount being calculated by the speed compensation part so as to be larger as a flow rate difference between the total target flow rate and a total actual flow rate becomes larger, the total actual flow rate being calculated by the speed compensation part and being a sum of a first actual flow rate which is an actual flow rate of the hydraulic fluid supplied to the first actuator and a second actual flow rate which is an actual flow rate of the hydraulic fluid supplied to the second actuator, when the combined manipulation is performed and the condition determination part determines that the load determination condition is satisfied.

8. The construction machine according to claim 7, wherein, when the total target flow rate calculated by the speed compensation part is higher than a total maximum discharge rate being a sum of a first maximum discharge rate which is a maximum discharge rate of the hydraulic fluid dischargeable from the first pump and a second maximum discharge rate which is a maximum discharge rate of the hydraulic fluid dischargeable from the second pump, the speed compensation part corrects the first target flow rate and the second target flow rate so that the total target flow rate is equal to or lower than the total maximum discharge rate while keeping a ratio between the first target flow rate and the second target flow rate.

9. The construction machine according to claim 8, further comprising:

a first discharge pressure detector that detects a first discharge pressure being a discharge pressure of the hydraulic fluid from the first pump;

a second discharge pressure detector that detects a second discharge pressure being a discharge pressure of the hydraulic fluid from the second pump;

an engine that drives the first pump and the second pump; and an output determination part that determines an output from the engine, wherein the speed compensation part calculates the total maximum discharge rate, on the basis of the output from the engine, the first discharge pressure, and the second discharge pressure.

* * * * *